US008126364B2

(12) United States Patent
Masaki et al.

(10) Patent No.: US 8,126,364 B2
(45) Date of Patent: Feb. 28, 2012

(54) ENDLESS MEMBER DRIVE APPARATUS AND IMAGE FORMING APPARATUS

(75) Inventors: Suto Masaki, Saitama (JP); Tatsuya Nakamura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 714 days.

(21) Appl. No.: 12/210,749

(22) Filed: Sep. 15, 2008

(65) Prior Publication Data

US 2009/0087231 A1 Apr. 2, 2009

(30) Foreign Application Priority Data

Oct. 1, 2007 (JP) ..... P2007-257938
Mar. 26, 2008 (JP) ..... P2008-080883

(51) Int. Cl.
*G03G 15/00* (2006.01)

(52) U.S. Cl. ..... 399/155

(58) Field of Classification Search ..... 399/121, 399/162, 165, 302
See application file for complete search history.

(56) References Cited

U.S. PATENT DOCUMENTS 6,457,709 B1 10/2002 Madsen et al. ..... 271/275

FOREIGN PATENT DOCUMENTS

| | | |
|---|---|---|
| JP | 04-121337 | 4/1992 |
| JP | 04-317936 | 11/1992 |
| JP | 08-123212 | 5/1996 |
| JP | 11-091977 | 4/1999 |
| JP | 2001-080782 | 3/2001 |
| JP | 2002-173246 | 6/2002 |
| JP | 2006-162659 | 6/2006 |
| KR | 2005-52185 | 6/2005 |

*Primary Examiner* — David Gray
*Assistant Examiner* — Barnabas Fekete
(74) *Attorney, Agent, or Firm* — Morgan, Lewis & Bockius LLP

(57) ABSTRACT

An endless member drive apparatus includes: an endless member that has plane surfaces and rotates by receiving a drive force; a drive support member that supports and drives the endless member; a rotatable support member that includes a rotation shaft, and that supports the endless member; a bearing member that includes: a bearing portion that supports the rotatable support member rotatably, and that supports the rotatable support member in such a manner that the rotatable support member can be moved in an intersecting direction to intersect a tensile direction where a tensile force is generated in the endless member; a positioning portion that positions the rotatable support member, wherein the rotatable support member is moved and positioned by using a force that, in a case where the endless member is rotated, is applied to the rotatable support member, and that goes in the intersecting direction.

13 Claims, 17 Drawing Sheets

ENDLESS MEMBER DRIVE APPARATUS AND IMAGE FORMING APPARATUS

CROSS-REFERENCE TO RELATED APPLICATIONS

This application is based on and claims priority under 35 U.S.C. 119 from Japanese Patent Application No. 2007-257938 filed Oct. 1, 2007 and Japanese Patent Application No. 2008-080883 filed Mar. 26, 2008.

BACKGROUND

1. Technical Field

The present invention relates to an endless member drive apparatus and an image forming apparatus.

2. Related Art

As a technology relating to a conventional image forming apparatus including an endless member, there are known technologies which are disclosed in the below-cited patent references, respectively.

SUMMARY

According to an aspect of the present invention, an endless member drive apparatus includes: an endless member that has plane surfaces and rotates by receiving a drive force; a drive support member that supports and drives the endless member; a rotatable support member that includes a rotation shaft, and that supports the endless member; a bearing member that includes: a bearing portion that supports the rotatable support member rotatably, and that supports the rotatable support member in such a manner that the rotatable support member can be moved in an intersecting direction to intersect a tensile direction where a tensile force is generated in the endless member; a positioning portion that positions the rotatable support member, wherein the rotatable support member is moved and positioned by using a force that, in a case where the endless member is rotated, is applied to the rotatable support member, and that goes in the intersecting direction.

BRIEF DESCRIPTION OF THE DRAWINGS

Exemplary embodiment of the present invention will be described in detail based on the following figures, wherein:

FIG. 4A is an explanatory view of the main portions of the printer, showing a state where the medium feed belt is not rotating, and FIG. 4B is an explanatory view of the main portions of the printer, showing a state where the medium feed belt is rotating;

FIG. 5A is an explanatory view, showing a state where the medium feed belt is moved to the rear side, and FIG. 5B is an explanatory view, showing a state where the medium feed belt is moved to the front side;

FIG. 6 is an explanatory view of the main portions of a driven roller and a driven bearing according to an embodiment 2 of the invention, and corresponds to FIG. 5 according to the embodiment 1. Specifically.

FIG. 11A is an explanatory view, showing a state where the medium feed belt does not lean, and FIG. 11B is an explanatory view, showing a state where the medium feed belt leans;

FIG. 12A is an explanatory view thereof, showing a state where a medium feed belt does not lean; FIG. 12B is an explanatory view thereof, showing a state where a medium feed belt leans; and, FIG. 12C is an explanatory view of the shaft inclining plate spring;

FIG. 13A is an explanatory view thereof, showing a state where a medium feed belt does not lean; and, FIG. 13B is an explanatory view thereof, showing a state where the medium feed belt leans;

FIG. 16A is an explanatory view of a state where the medium feed belt does not lean; FIG. 16B is an explanatory view of a state where the medium feed belt leans; and, FIG. 16C is an explanatory view of a state where the medium feed belt leans further from the state shown in FIG. 16B.

DETAILED DESCRIPTION

Figure 1:
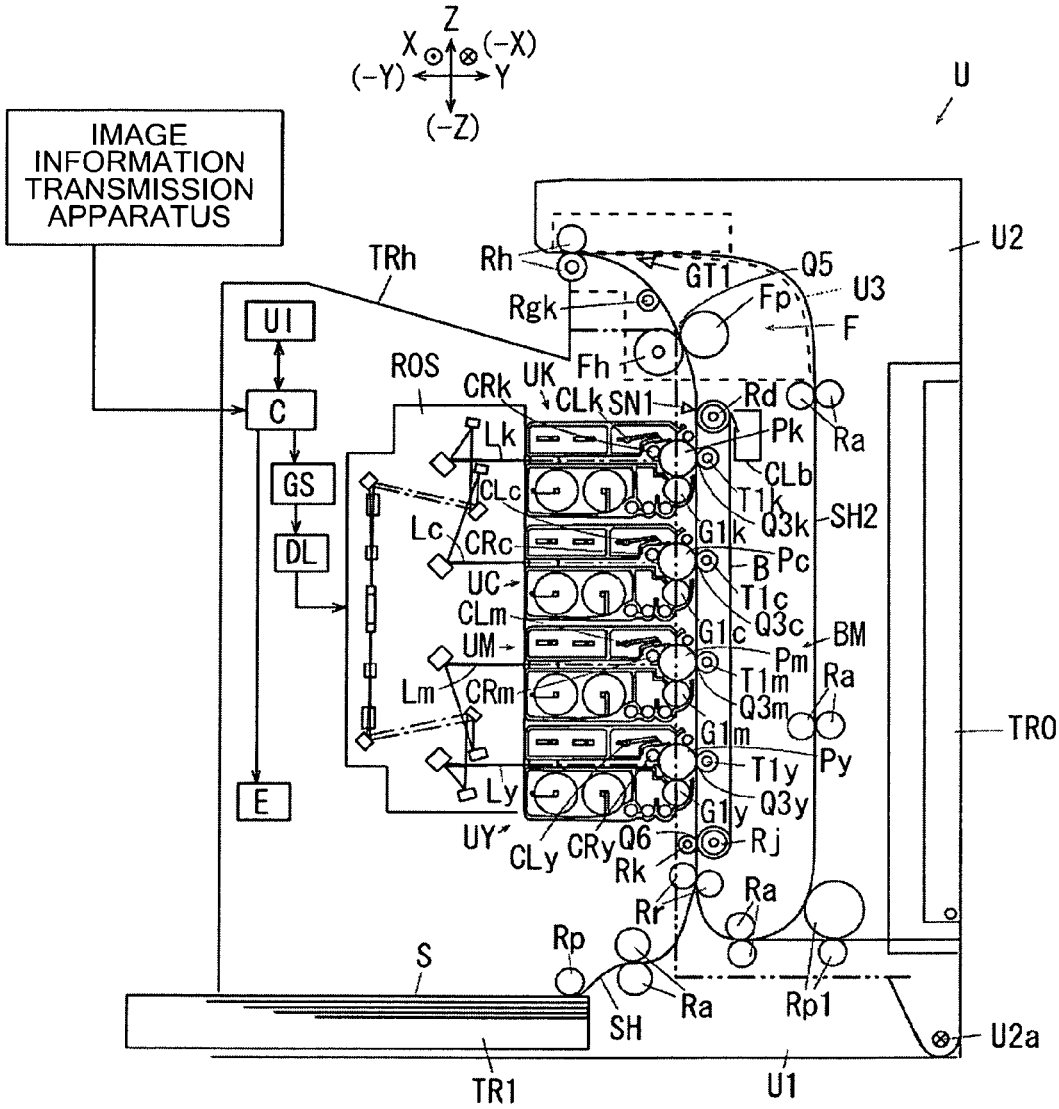
FIG. 1 is an explanatory view of the whole of an image forming apparatus according to an embodiment 1 of the invention.

Next, description will be given below of specific examples (which are hereinafter referred to as embodiments) according to the invention with reference to the accompanying drawings. However, the invention is not limited to the following embodiments illustrated herein.

By the way, for easy understanding of the following description, in the drawings, the back and forth direction is expressed as the X-axis direction, the left direction is expressed as the Y-axis direction, the vertical direction is expressed as Z-axis direction; and, the directions or sides, which are shown by the arrow marks X, −X, Y, −Y, Z, and −Z, are expressed respectively as the forward direction, rearward direction, right direction, left direction, upward direction, and downward direction, or, the front side, rear side, right side, left side, upper side and lower side.

Also, in the drawings, an expression, in which [.] is stated within [O], means an arrow mark going from the back of the surface of a sheet to the front thereof; and, an expression, in which [x] is stated within [O], means an arrow mark going from the front to the back.

Further, in the following description with reference to the drawings, for easy understanding, the illustration of other composing elements than elements necessary for the description will be omitted properly.

(Embodiment 1)

FIG. 1 is an explanatory view of the whole of an image forming apparatus according to an embodiment 1 of the invention.

Figure 2:
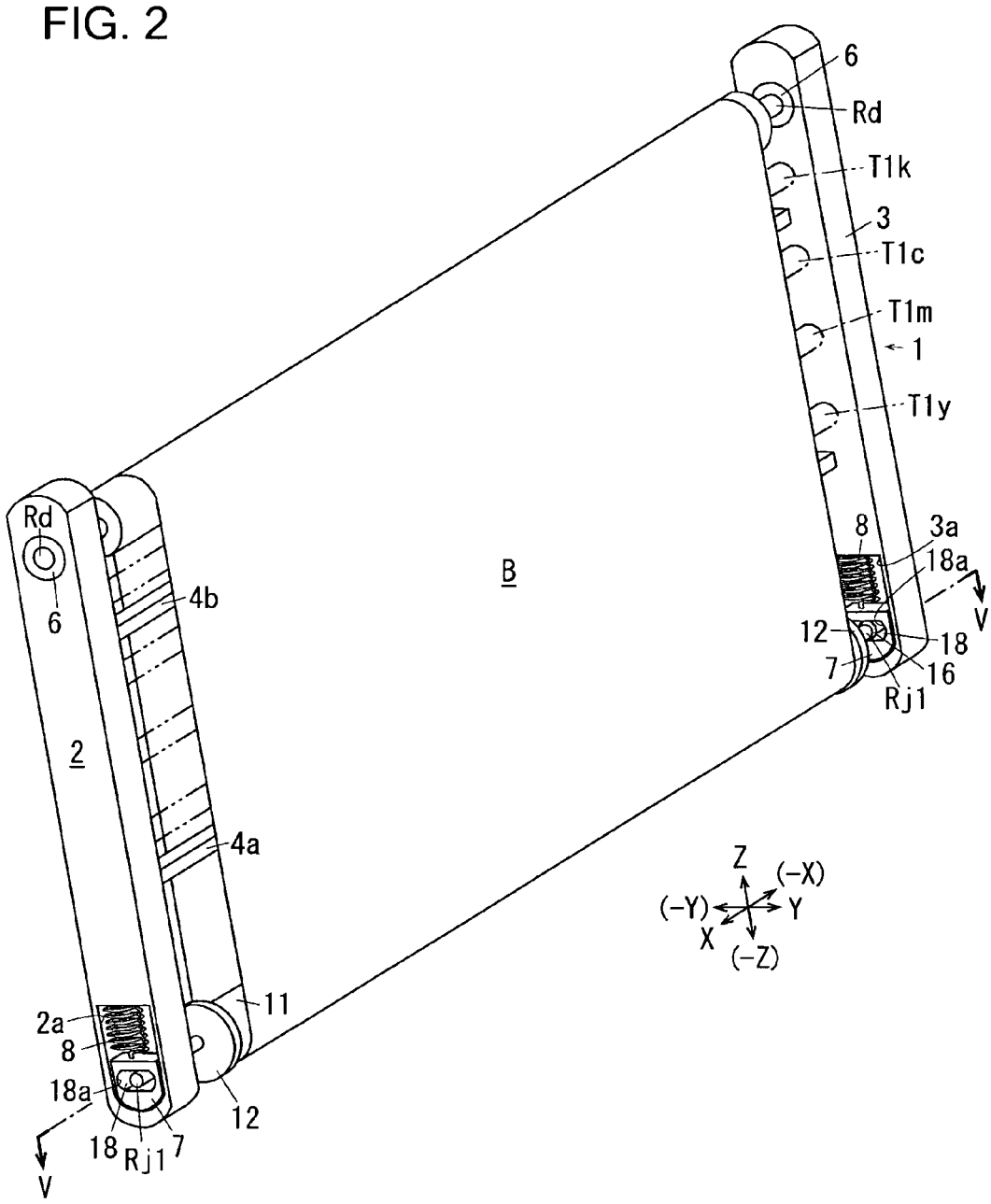
FIG. 2 is an enlarged perspective view of the main portions of a belt module according to the embodiment 1 of the invention.

FIG. 2 is an enlarged perspective view of the main portions of a belt module according to the embodiment 1 of the invention.

Figure 3:
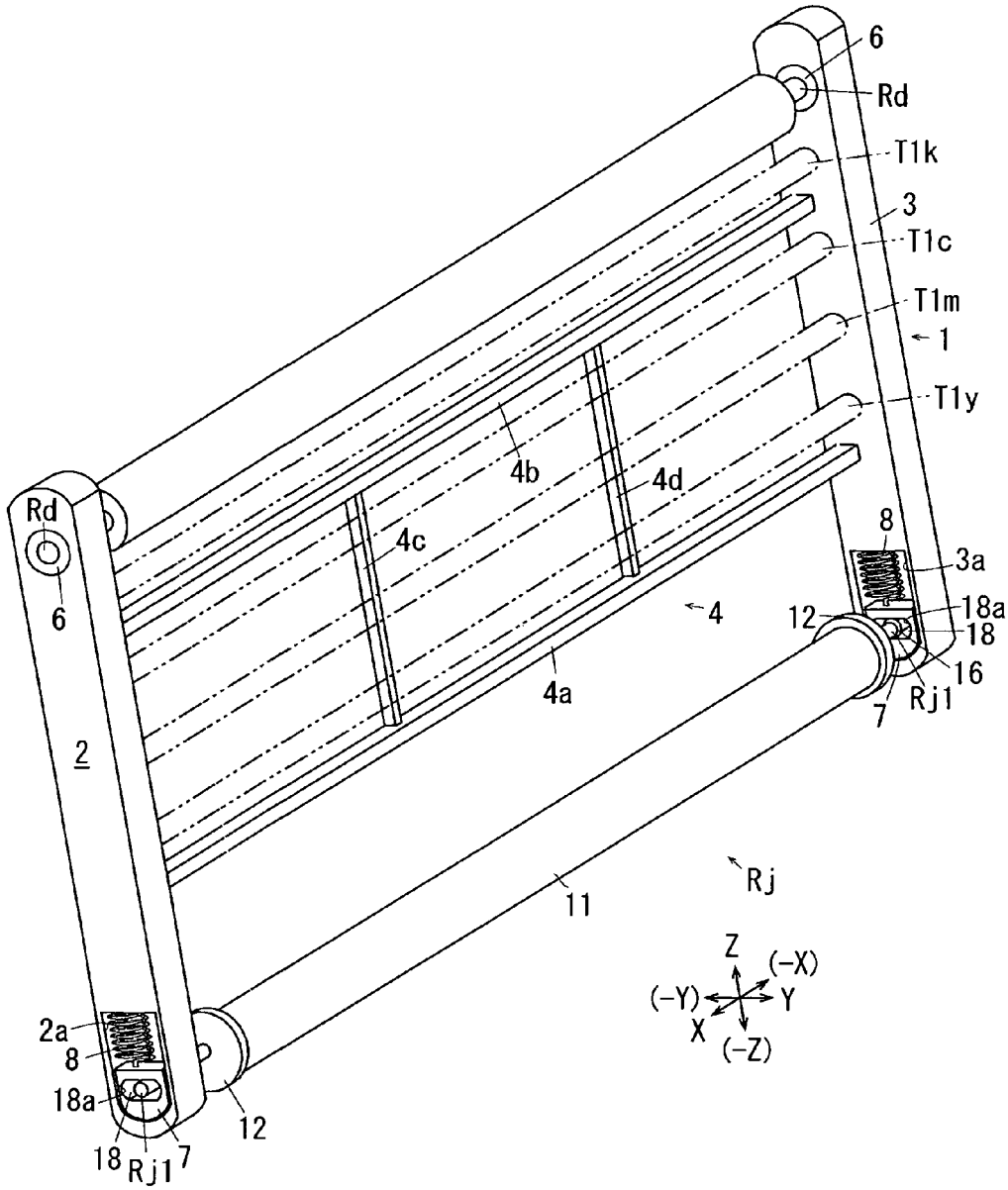
FIG. 3 is an explanatory view of the belt module shown in FIG. 2, showing a state in which a medium feed belt is removed therefrom.

FIG. 3 is an explanatory view of the belt module shown in FIG. 2, showing a state where a medium feed belt is removed therefrom.

Figure 4A:
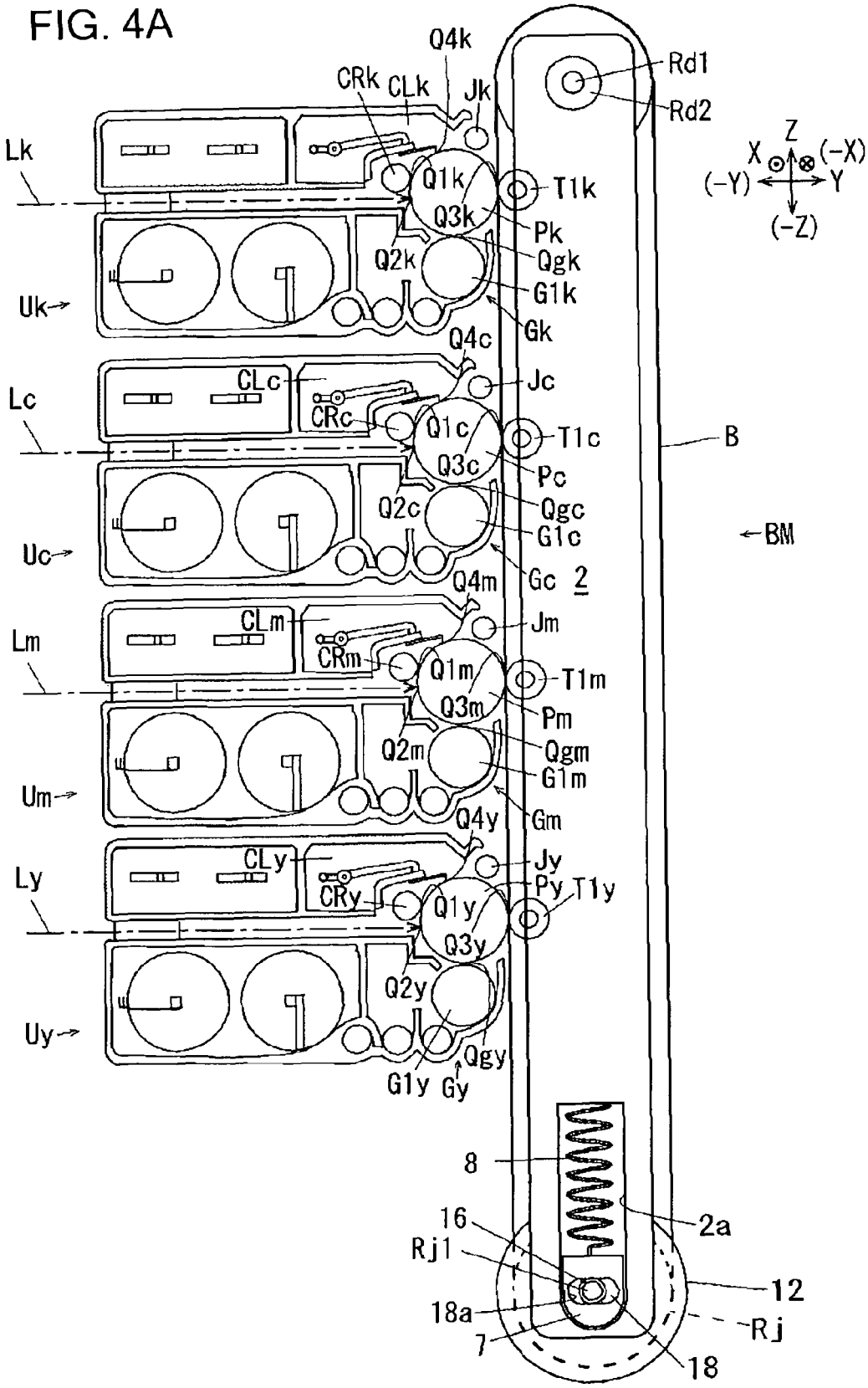
FIGS. 4A and 4B are explanatory views of the main portions of a printer, Specifically.
Figure 4B:
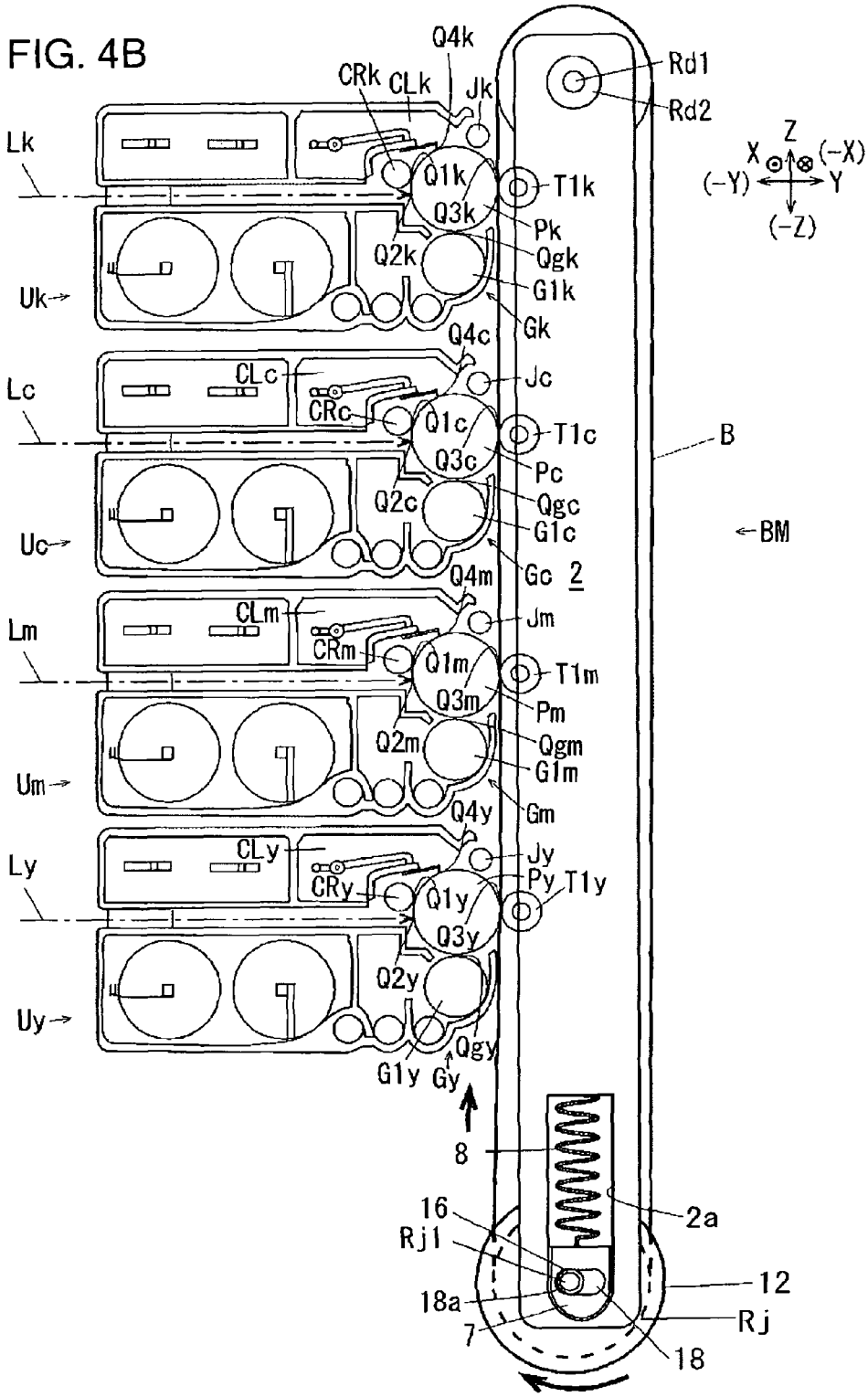

FIG. 4 is an explanatory view of the main portions of a printer. Specifically, FIG. 4A is an explanatory view of the main portions of the printer, showing a state where the medium feed belt is not rotating, and FIG. 4B is an explanatory view of the main portions of the printer, showing a state where the medium feed belt is rotating. Here, in FIG. 4, there is omitted the illustration of a rear side frame body and the like.

In FIG. 1, there is shown a printer U used as an example of the image forming apparatus according to the embodiment 1 of the invention. In the lower portion of the printer U, there is stored a sheet supply container TR1 into which there is stored a recording medium S used as an example of a medium; and, on the upper surface of the printer U, there is provided a medium discharge portion TRh. Also, on the left upper portion of the printer U, there is provided an operation portion UI.

The printer U according to the embodiment 1 includes an image forming apparatus main body U1 and an open-close portion U2 which can be opened and closed about a rotation center U2*a* set in the right lower end portion of the image forming apparatus main body U1. The open-close portion 12 is structured such that it can be moved between an open position and a closed position: Specifically, the open position is a position where the inside of the image forming apparatus main body U1 is opened in order to supply a developer, or replace a wrong member with a new one, or remove a clogged recording medium S; and, the closed position is a position where an image forming operation is carried out and the open-close portion U2 is held in the normal time.

The printer U includes a control portion C for carrying out various control operations of the printer U, an image processing portion GS, an image write device drive circuit DL, a power supply device E and the like, the operations of which can be controlled by the control portion C. The power supply device E is used to apply a voltage to: charging rollers CRy, CRm, CRc and CRk respectively used as examples of a charging device; developing rollers G1*y*, G1*m*, G1*c* and G1*k* respectively used as examples of a developer holder; transfer rollers T1*y*, T1*m*, T1*c* and T1*k* respectively uses as examples of a transfer device; and the like.

The image processing portion GS converts print information, which is input therein from an external image information transmission device or the like, to image information for forming latent images corresponding to the images of four colors, that is, Y (yellow), M (magenta), C (cyan) and K (black), and outputs the thus converted image information to the image write device drive circuit DL at a given timing. The image write device drive circuit DL, according to the respective pieces of color image information input therein, outputs a drive signal to a latent image write device ROS. The latent image write device ROS, according to the drive signal, radiates laser beams Ly, Lm, Lc and Lk which are used as examples of an image write light for writing the respective color images.

In FIG. 1, on the right of the latent image write device ROS, here are disposed process cartridges UY, UP, UC and UK serving as examples of a visible image forming apparatus for forming toner images used as examples of the visible images of the respective colors, that is, Y (yellow), M (magenta), C (cyan) and K (black).

In FIGS. 1 and 4, the process cartridge UK for K (black) includes a sensitive body Pk used as an example of an image holder which is rotating. Around the sensitive body Pk, there are arranged a charging roller CRk used as a charging device, a developing device Gk for developing an electrostatic latent image on the surface of the sensitive body Pk to a visible image, an electricity removing member Jk for removing an electricity from the surface of the sensitive body Pk, and a sensitive body cleaner CLk used as an example of an image holder cleaner for removing a developer remaining on the surface of the sensitive body Pk.

In FIGS. 1 and 4, the surface of the sensitive body Pk is charged uniformly by the charging roller CRk in a charging area Q1*k* disposed opposed to the charging roller CRk. After then, a latent image is written onto the surface of the sensitive body Pk by the laser beam Lk in a latent image forming area Q2*k*. The thus written electrostatic latent image is converted to a visible image in a developing area Qgk disposed opposed to the developing device Gk.

The process cartridge UK for black according to the embodiment 1 is composed of a mounting and removing body which is structured such that the sensitive body Pk, charging roller CRk, developing device Gk, electricity removing member Jk, sensitive body cleaner CLk and the like are formed as an integral body; and also, the process cartridge UK, in a state where the open-close portion U2 is moved to its opening position, can be mounted onto and removed from the image forming apparatus main body U1.

Process cartridges UY, UM and UC for the remaining colors, similarly to the process cartridge UK for black, are also structured such that they can be mounted onto and removed from the image forming apparatus main body U1.

In FIGS. 1 to 4, on the right of the respective sensitive bodies Py to Pk, there is disposed a belt module BM which serves not only as an example of an endless member drive apparatus supported on the open-close portion U2 but also as an example of a medium feed device. The belt module BM includes a medium feed belt B used as an example of an endless member. Also, on the belt module BM, there are supported a drive roller Rd used as an example of a drive support member for supporting the medium feed belt B and a driven roller Rj used as an example of a rotation support member; and, the drive roller Rd and driven roller Rj cooperate together in constituting a belt support roller Rd+Rj used as an example of a hold feed member support system for supporting the medium feed belt R rotatably. Also, on the belt module BM, there are supported not only transfer rollers T1*y* to T1*k* used examples of transfer devices respectively disposed opposed to their associated sensitive bodies Py to Pk, and a belt cleaner CLb used as an example of a cleaner.

The recording medium S in the sheet supply container TR1 disposed downwardly of the medium feed belt B is taken out by a sheet supply member Rp and is fed to a recording medium feed passage SH.

The recording medium S in the recording medium feed passage SH is fed by a medium feed roller Ra used as an example of a recording medium Feed member and is sent to a regi-roller (registration roller) Rr used as an example of a sheet supply registering member. The regi-roller Rr, at a given timing, feeds the recording medium S to the medium feed belt B, and the recording medium S is fed upwardly while it is held on the surface of the medium feed belt B.

When the recording medium S is supplied from a manually operated sheet supply portion TR0, the recording medium S supplied by a manually operated sheet supply member Rp1 is fed to the regi-roller Rr by the medium feed roller Ra and is then fed to the medium feed belt B.

The recording medium S held on the medium feed belt B is allowed to pass through the transfer areas Q3*y*, Q3*m*, Q3*c* and Q3*k* sequentially in this order, where the recording medium S can be contacted with the sensitive bodies Py to Pk.

To transfer rollers T1*y* to T1*k* disposed on the back surface side of the medium feed belt B in the transfer areas Q3*y* to Q3*k*, there is applied a transfer voltage having a reversed polarity to the charging polarity of the toner from the power supply circuit E at a given timing.

In the case of a multicolor image, the toner images on the respective sensitive bodies Py to Pk are transferred respectively by the transfer rollers T1*y* to T1*k* to the recording medium S on the medium feed belt B while they are superimposed on top of each other. Also, for a single color image, that is, for a so called monochrome image, only the toner image for K (black) is formed on the sensitive body Pk and thus this K (black) toner image is transferred to the recording medium S by the transfer roller T1*k*.

After execution of the toner image transfer, the charged electricity of the sensitive bodies Py to Pk is removed by the electricity removing members Jy to Jk in the electricity removing areas Qjy to Qjk. After then, the toner remaining on the surfaces of the sensitive bodies Py to Pk is cleaned by their associated sensitive body cleaners CLy to CLk in their respective cleaning areas Q4*y* to Q4*k*; and, after then, the sensitive bodies Py to Pk are respectively charged again by their associated charging rollers CRy to CRk.

The recording medium S, to which the toner image has been transferred, is fixed in a fixing area Q5 which is formed in such a manner that a heating roller Fh used as an example of a heading fixing member of a fixing device F used as a fixer and a pressurizing roller Fp used as an example of a pressurizing and fixing member are pressure contacted with each other. The recording medium S with the image fixed thereto is guided by a guide roller Rgk used as an example of a guide member and is discharged from a discharge roller Rh used as an example of a medium discharge member to the medium discharge portion TRh.

The medium feed belt B, after the recording medium S is removed therefrom, is cleaned by the belt cleaner CLb.

When both sides of the recording medium S are printed, the discharge roller Rh is driven and is rotated reversely, whereby the recording medium S is fed to a medium reverse passage SH2 by a switching member GT1 and is fed again to the regi-roller Rr while the front and back thereof are reversed.

By the way, according to the embodiment 1, the fixing device F, the lower drive roller of the discharge roller Rh, switching gear GT1, and the lower guide surface of the medium reverse passage SH2 are constituted by a so called fixing unit U3. Also, the upper driven member of the discharge roller Rh is supported on the open-close portion U2.

(Description of Belt Module)

In FIGS. 2 and 3, the belt module BM includes a frame body 1 used as an example of a support body for supporting the medium feed belt B. The frame body 1 includes a front frame body 2 disposed on the front side thereof, a rear frame body 3 disposed on the rear side thereof, and a connecting frame body 4 for connecting together the front frame body 2 and rear frame body 3. The connecting frame body 4 includes a lower connecting frame body 4*a* and an upper connecting frame body 4*b* which extends substantially parallel to each other; and, the two connecting frame bodies 4*a* and 4*b* cooperate together in connecting the front and rear frame bodies 2 and 3 to each other.

The lower connecting frame body 4*a* and upper connecting frame body 4*b* are connected to each other by two pieces of inter-frame connecting members 4*c* and 4*d*.

On the respective upper end portions of the front and rear frame bodies 2 and 3, there are supported drive bearings 6 which support the drive shafts Rd1 of the drive rollers Rd.

In FIG. 3, as shown by two-dot chained lines, between the front frame body 2 and rear frame body 3, there are interposed the transfer rollers T1*k*, T1*c*, T1*m* and T1*y* downwardly of the drive roller Rd in such a manner that they are arranged substantially parallel to each other. Also, these transfer rollers are supported rotatably and are urged by springs (not shown) in such a direction that they can be pressed against their associated sensitive bodies Pr, Pc, Pm and Py.

The front frame body 2, rear frame body 3 and connecting frame body 4 cooperate together in constituting the frame body 1 according to the embodiment 1.

Also, in the lower ends of the front frame body 2 and rear frame body 3, as an example of a bearing receiving portion, there are formed a pair of front and rear bearing receiving openings 2*a* and 3*a* which respectively extend in the vertical direction. In the bearing receiving openings 2*a* and 3*a*, as an example of a bearing member, there are supported driven bearings 7 vertically rotatably which support the driven shafts Rj1 of the driven rollers respectively. Between the driven bearings 7 and bearing receiving openings 2*a*, 3*a*, there are mounted tension springs 8 which respectively apply such forces as to move their associated driven bearings 7 in the downward direction.

Figure 5A:
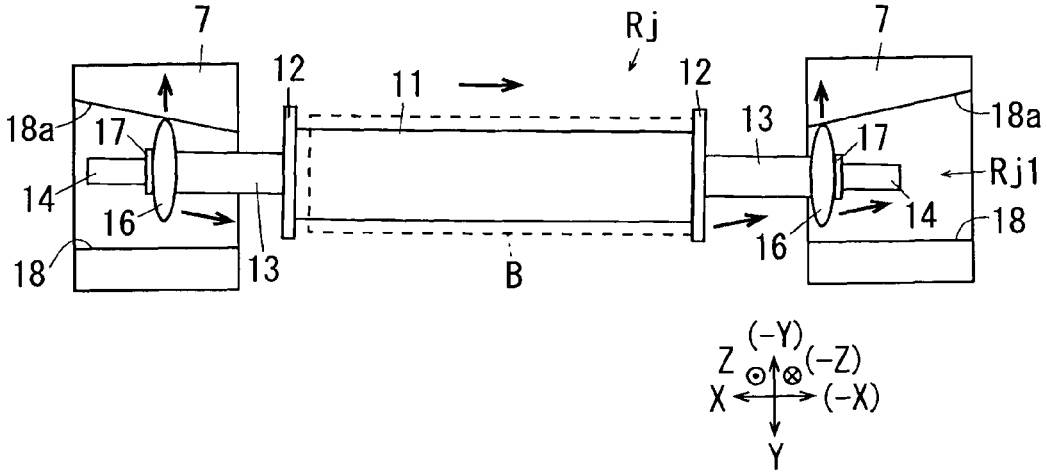
FIGS. 5A and 5B are explanatory views of the main portions of the driven rollers and driven bearings according to the embodiment 1 and is a section view taken along the V-V line shown in FIG. 2, specifically.
Figure 5B:
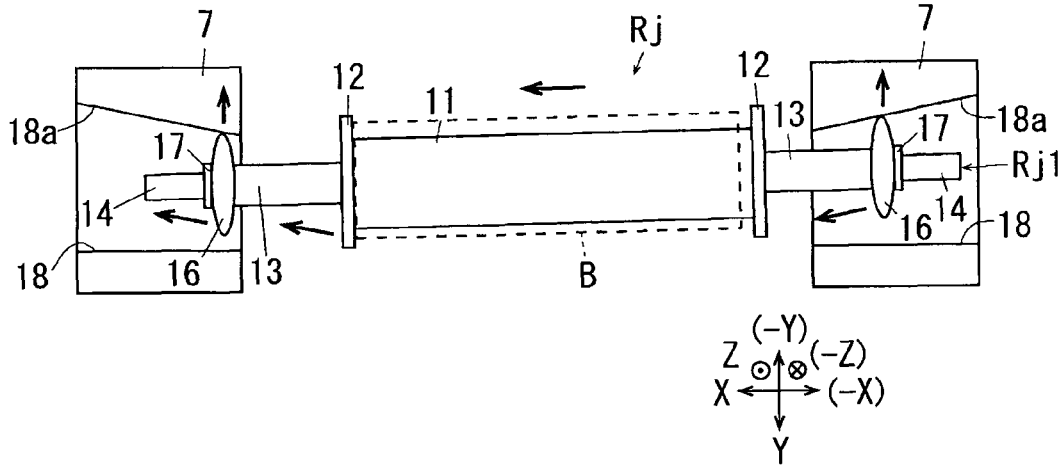

Now, FIG. 5 is an explanatory view of the main portions of the driven rollers and driven bearings according to the embodiment 1 and is a section view taken along the V-V line shown in FIG. 2. Specifically, FIG. 5A is an explanatory view, showing a state where the medium feed belt is moved to the rear side, and FIG. 5B is an explanatory view, showing a state where the medium feed belt is moved to the front side.

In FIG. 5, a driven roller Rj according to the embodiment 1, which is used as an example of a rotation support member, includes, as an example of a support member main body, a roller main body 11 which is arranged in the central portion of the driven shaft Rj1 in the axial direction thereof and is used to support the medium feed belt B. On the two end portions of the roller main body 11, there are supported disk-shaped flanges 12 which not only serve as an example of an end edge contact portion but also serve as an example of a round edge member. Here, in the driven roller Rj according to the embodiment 1, between the two flanges 12, there is supported the medium feed belt B, while the distance between the two flanges 12 is set equal to or larger than the width of the medium feed belt B.

On the two axial-direction outer sides of the driven shaft Rj1, there are formed large-diameter portions 13 respectively; and, in the two axial-direction end portions of the large-diameter portions 13, there are formed small-diameter portions 14 respectively. That is, the driven shaft Rj1 according to the embodiment 1 is made of a so called staged shaft.

On the small-diameter portion 14 of each driven shaft Rj1, as an example of a portion to be positioned, there is mounted a disk-shaped small bearing 16. The small bearing is positioned in a state where it is butted against the step portion of the outer end portion of the large-diameter portion 13; and also, the small bearing 16 is supported by an E ring 17 used as an example of a position fixing member disposed outwardly of the small bearing 16 in such a manner that it is prevented from rotating in the axial direction.

In FIGS. 2 to 5, the two driven bearings 7, which support the two end portions of the driven shaft Rj1, respectively include bearing portions 18 extending in the right and left direction which crosses the vertical direction. Here, the vertical direction is a direction where a tensile force is generated by the tension springs 8 which are used to carry the medium feed belt B thereon. Each of the bearing portions 18 according to the embodiment 1 is formed of a long hole extending in the right and left direction perpendicular to the vertical direction that is the tensile force generating direction; the minor axis of the long hole is formed so as to correspond to the outer shape of the small bearing 16; and, the major axis of the long hole is formed longer than the outer shape of the small bearing 16. By the way, although, in the embodiment 1, the bearing portion 18 is formed as a long hole, the shape of the bearing portion 18 is not limited to the long hole shape but, for example, the bearing portion 18 may also have a rectangular shape extending in the right and left direction; and also, the angle of the extension of the bearing portion 18 is not limited to the right angles, that is, 90° but may also be set at any arbitrary angle in the vicinity of 90°.

In FIG. 5, in the left end face of the bearing portion 18 formed of a long hole, there is formed a positioning surface 18*a* used as an example of a positioning portion with which the small bearing 16 is contacted to position the driven roller Rj. In FIG. 5, the positioning surface 18*a* is made of an inclining surface which, as it goes outwardly in the axial direction, inclines to the left side that is the outside in the diameter direction of the driven shaft Rj1. That is, according to the embodiment 1, the positioning surface 18*a* is formed in the bearing portion 18 the major diameter of the long hole of which, when it is viewed from the axial direction, increases as it goes to the outside in the axial direction.

(Operation of Embodiment 1)

The belt module BM according to the embodiment 1 which has the above-mentioned structure and is used as an endless member drive device, in a state where the medium feed belt B is not driven, as shown in FIG. 4A, is supported freely movably in the right and left direction in such a manner that the outer surface of the small bearing 16 is contacted with the inner surface of the long-hole-shaped bearing portion 18 of the driven bearing 7. Therefore, the driven roller Rj is rotatably supported on the driven bearing 7 through the bearing portion 18 and small bearing 16 in such a manner that it can be moved freely in the right and left direction. In this case, since the driven roller Rj receives a reacting force due to the tensile force of the medium feed belt B that is generated by the tension spring 8, the driven roller Rj is held in a state where the reacting force is small, that is, the distance between the driven roller Rj and drive roller Rd is shortest. In other words, as shown in FIG. 4A, the driven roller Rj is held in a state where it stops in the vicinity of the central portion in the right and left direction of the long hole of the bearing portion 18.

When the medium feed belt B is driven and rotated, owing to the moment that is generated with the rotation of the medium feed belt B, the driven roller Rj receives a force to move it to the left. In this case, as shown in FIG. 4B, the driven roller Rj, which is supported on the driven bearing 7 in such a manner that it can be moved freely in the right and left direction, is moved left from the state shown in FIG. 4A. And, the driven roller Rj stops in a state where the small bearing 16 is butted against the positioning surface 18*a* of the left end face of the bearing portion 18, and is positioned there. Therefore, while the medium feed belt B is rotating, the driven roller Rj supports the medium feed belt B in a stare where it is positioned by the positioning surface 18*a*, and, as the medium feed belt B is rotated, it is driven and rotated.

In FIG. 5, there is a possibility that the medium feed belt B, while it is rotating, is caused to lean in the width direction or can be made to meander according to the degree of the parallelism between the drive roller Rd and driven roller Rj. In FIG. 5A, when the medium feed belt B leans backward, the rear end edge of the medium feed belt B is contacted with the rear flange 12, whereby the driven roller Rj receives a force which presses it backward. When the driven roller Rj is moved backward in the axial direction in linking with the backward pressing force, the contact position between the small bearing 16 and positioning surface 18*a* is shifted backward. In this case, according to the embodiment 1, since the positioning surface 18*a*, against which the small bearing 16 is to be butted, is made of an inclining surface which inclines left as it goes outward in the axial direction, due to the axial-direction backward movement of the driven roller Rj, as shown in FIG. 5B, the driven roller Rj turns into a state where the axial-direction front side thereof is inclined right when compared with the axial-direction rear side thereof. In a state shown in FIG. 5B, since the medium feed belt B receives a forward moving force, the leaning of the medium feed belt B is corrected. On the contrary to this, in a state shown in FIG. 5B, when the medium feed belt B leans forward and the front end edge of the medium feed belt B is contacted with the front flange 12, the driven roller Rj is moved forward and inclines so as to correct the leaning of the medium feed belt B.

Therefore, in the belt module BM according to the embodiment 1, not only the position of the driven roller Rj can be positively positioned at a given position using the rotation of the medium feed belt B, but also, in a state where the driven roller Rj is pressed against the positioning surface 18*a* made of an inclining surface using the rotation of the medium feed belt B, the driven roller Rj is moved in the axial direction, whereby the leaning of the medium feed belt B is corrected. That is, according to the prior art, there are found restrictions to the position of the roller: specifically, when a roller is supported on an arm which is rotating and moving, in order to position the roller at a given position, it is necessary to use a spring which urges the roller toward the given position; and, when gravity is used, the feed surface of the medium feed belt B must be arranged horizontal. When compared with the prior art, according to the embodiment 1, regardless of the position of the roller, the roller can be positioned at a given position using the rotational force of the medium feed belt B itself and also the number of parts such as springs can also be reduced.

Also, according to the conventional belt feed apparatus, the meandering amount of the belt is caused to vary according to the positioning precision of a shaft such as the degree of the parallelism of the shaft and the load to be applied onto the belt is determined by such variable meandering amount of the belt, which raises the need that the degree of the parallelism between the shafts must be maintained using the precision of the parts. In some cases, it is necessary to adjust the position of the belt on the shaft when the parts are assembled together, which requires an assembling jig and the like. On the other hand, according to the embodiment 1, whether the rollers Rd and Rj are inclined in their initial states or not, or whether the position of the medium feed belt B is set at any position on the driven shaft Rj1, the present belt module BM has a characteristic that, when it starts its driving operation once, the medium feed belt B is sure to move to a balanced position where the meandering of the medium feed belt B is caused to stop. Therefore, when compared with the conventional technology, the belt module BM according to the embodiment 1 has a structure that does not require the high positioning precision of the rollers or the high assembling precision of the parts.

(Embodiment 2)

Figure 6A:
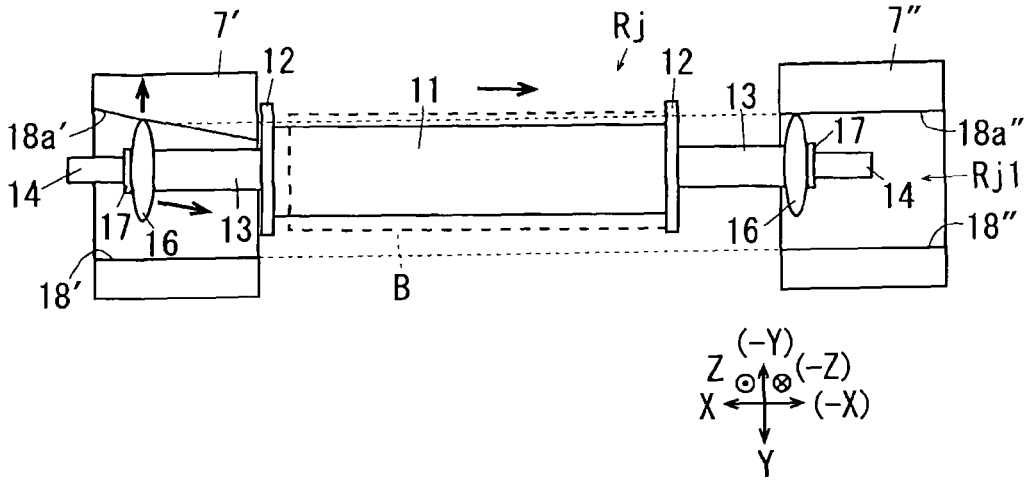
FIG. 6A is an explanatory view thereof, showing a state where a medium feed belt leans backward.
Figure 6B:
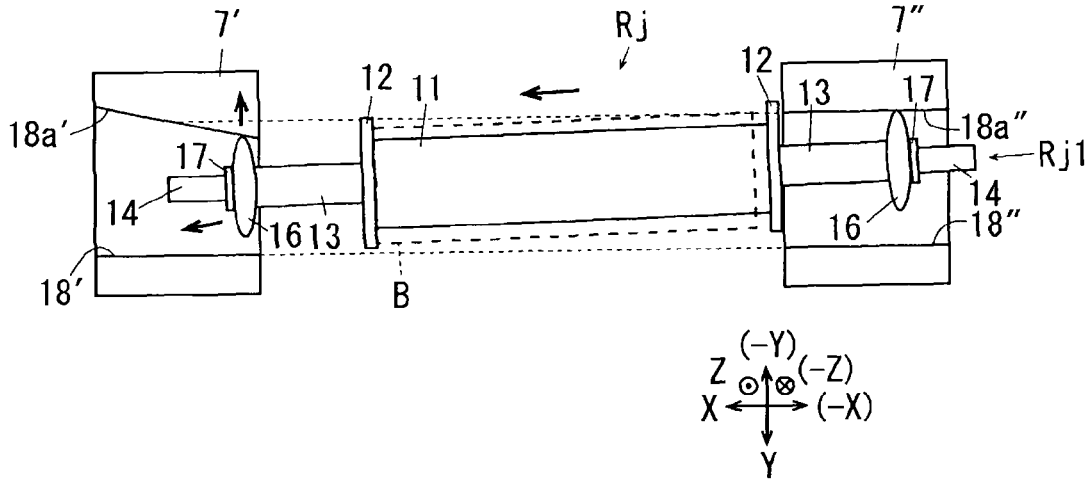
FIG. 6B is an explanatory view thereof, showing a state where a medium feed belt leans forward.

FIG. 6 is an explanatory view of the main portions of a driven roller and a driven bearing according to an embodiment 2 of the invention, and corresponds to FIG. 5 according to the embodiment 1. Specifically, FIG. 6A is an explanatory view thereof, showing a state where a medium feed belt leans backward, and FIG. 6B is an explanatory view thereof, showing a state where a medium feed belt leans forward.

Next, description will be given below of the embodiment 2 of the invention. In the following description of the embodiment 2, the composing elements thereof corresponding to those of the embodiment 1 are given the same designations and thus the detailed description thereof is omitted here.

The present embodiment is different from the embodiment 1 in the following aspects but, in the other remaining aspects, the present embodiment is structured similarly to the embodiment 1.

In FIG. 6, an image forming apparatus according to the embodiment 2 is structured such that an inclining surface is formed only in a driven bearing 7' disposed on the front side, but no inclining surface is formed in a driven bearing 7" disposed on the rear side, and the inclining surface is made of a long hole 18' having a positioning surface 18*a*". In this case, the position of the positioning surface 18*a*" in the moving direction of a driven roller Rj is set so as to correspond to the position of the axial-direction central portion of the inclining surface 18*a*' of the front driven bearing 7'.

(Operation of Embodiment 2)

In the image forming apparatus according to the embodiment 2 having the above structure, similarly to the embodiment 1, using the rotational force of the medium feed belt B, the small bearing 16 is butted against the positioning surfaces 18*a*' and 18*a*" to thereby determine the position of the driven roller Rj. Also, as shown in FIG. 6A, when the medium feed belt B leans backward, the driven roller Rj is moved while the small bearing 16 remains butted and the driven roller Rj remains positioned, whereby the state of the medium feed belt B is changed to the state shown in FIG. 6B and thus the backward leaning of the medium feed belt B is corrected. When the medium feed belt B leans forward, the driven roller Rj is moved in the axial direction whereby the state of the medium feed belt B is changed to the state shown in FIG. 6A and thus the forward leaning of the medium feed belt B is corrected.

(Embodiment 3)

Figure 7:
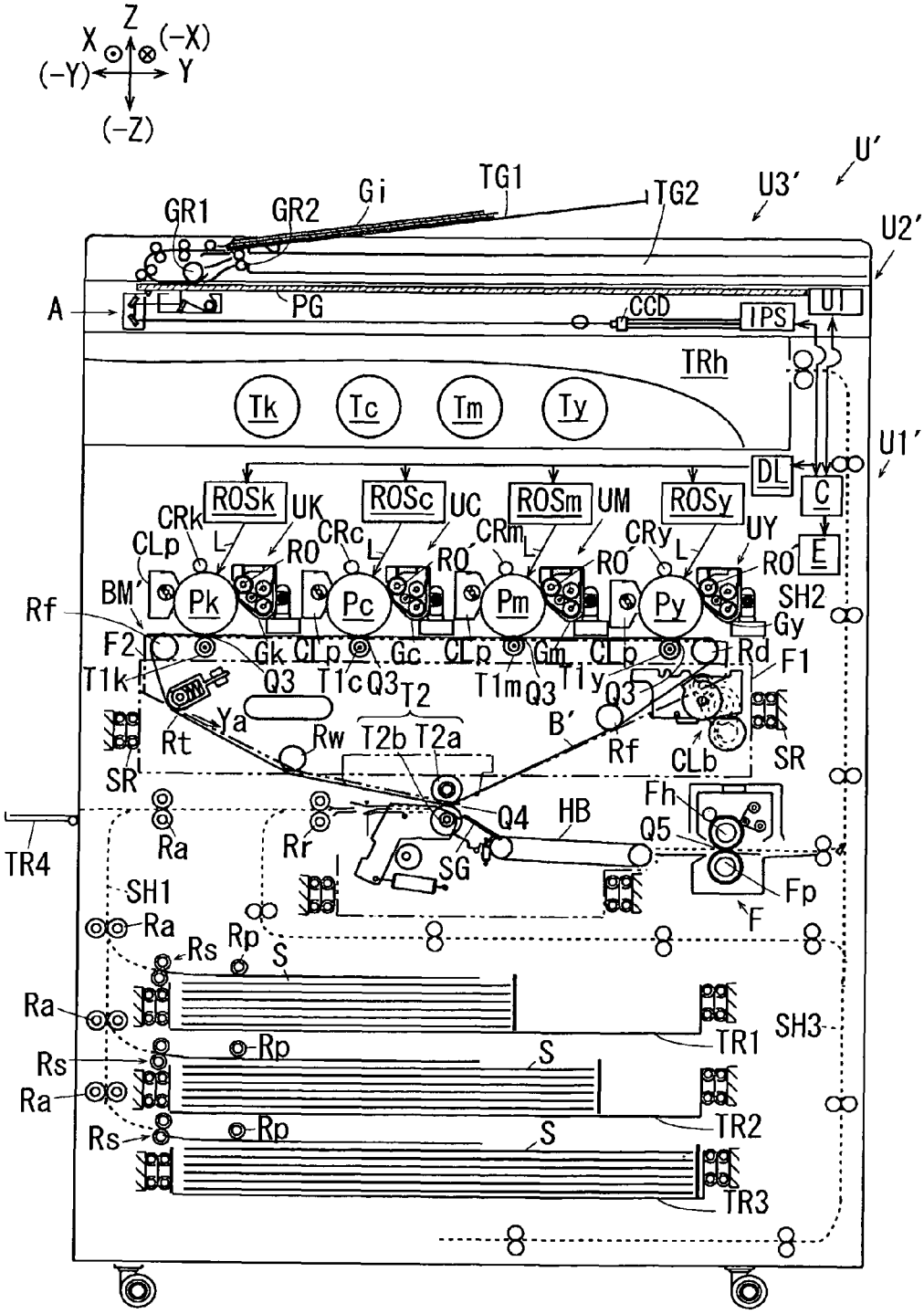
FIG. 7 is an explanatory view of the whole of an image forming apparatus according to an embodiment 3 of the invention.

FIG. 7 is an explanatory view of the whole of an image forming apparatus according to the embodiment 3 of the invention.

Next, description will be given below of the embodiment 3 of the invention. In the following description of the embodiment 3, the composing elements thereof corresponding to those of the embodiment 1 are given the same designations and thus the detailed description thereof is omitted here.

The present embodiment is different from the embodiment 1 in the following aspects but, in the other remaining aspects, the present embodiment is structured similarly to the embodiment 1.

In FIG. 7, a digital color copying machine U, which is used as an example of the image forming apparatus according to the embodiment 3, includes a printer portion U1' used as an example of an image record apparatus, an image scanner U2' used as an example of an image read apparatus, and an automatic manuscript feed apparatus U3'

The automatic manuscript feed apparatus U3' is supported on a platen glass PG which is used an example of a transparent manuscript base disposed on the upper surface of the image scanner U2'.

The automatic manuscript feed apparatus U3' includes a manuscript supply tray TG1 used as an example of a manuscript supply portion on which a plurality of manuscripts Gi to be copied can be placed on top of each other. The plurality of manuscripts Gi placed on the manuscript supply tray TG1 are allowed to pass sequentially one by one through a copying position set on the platen glass PG and are then discharged from a manuscript discharge roller GR2 used as an example of a manuscript discharge member to a manuscript discharge tray TG2 used as an example of a manuscript discharge portion.

The automatic manuscript feed apparatus U3' can be rotated with respect to the upper surface of the platen glass PG through a rotation shaft which is provided on the rear end portion of the automatic manuscript feed apparatus U3' and extends in the right and left direction; and, when an operator places the manuscripts Gi manually on the platen glass PG in a manual manuscript reading operation, the automatic manuscript feed apparatus U3' is rotated upwardly.

The image scanner U2' includes an operation portion UI through which a user operates and inputs an operation instruction signal such as a copy start signal.

Downwardly of the transparent platen glass PG, there is disposed an exposure optical system A which is used to read a manuscript image.

The light, which is reflected from a manuscript fed by the automatic manuscript feed apparatus U3' onto the upper surface of the platen glass PG and passing through the copy position, or which is reflected from a manuscript manually placed on the upper surface of the platen glass PG, is converted through the exposure optical system A to an electric signal by a solid state imaging element CCD.

An image processing portion IPS converts an electric signal input from the solid state imaging element CCD to image information and stores it therein temporarily, and then outputs the image information as image information for forming a latent image at a given timing to a laser drive circuit DL used as an example of a latent image forming device drive circuit.

The laser drive circuit DL, according to the image information input therein, outputs a drive signal to a latent image forming device ROS. Here, the operations of the above-mentioned operation portion U1, image processing portion IPS and laser drive circuit DL as well as the operation of the below-mentioned a power supply circuit E or applying a bias voltage to a developing roller R0, primary transfer rollers T1*y*, T1*m*, T1*c*, T1*k* and a secondary transfer roller T2*b* are controlled by a control portion C.

The laser drive circuit DL, into which there are input four pieces of image information respectively for four colors, that is, Y, M, C and K output from the image processing portion IPS, outputs drive signals of the respective colors corresponding to the thus input four pieces of color image information to their associated latent image forming devices ROSy, ROSm, ROSc and ROSk at a given timing.

As an example of an image holder, there are used sensitive bodies Py, Pm, Pc, and Pk. After these sensitive bodies are charged uniformly by charging rollers Cry, CRm, CRc and CRk respectively used as an example of a charging member, electrostatic latent images are formed on the surfaces of the sensitive bodies using latent image write lights L which are output from the latent image forming devices ROSy to ROSk. The electrostatic latent images on the surfaces of the sensitive bodies Py, Pm, Pc, and Pk are respectively developed in a developing area disposed opposed to developing devices Gy, Gm, Gc, Gk to toner images for the respective colors Y, M, C, K as an example of a visible image. To the developer containers V of the developing devices Gy, Gm, Gc, Gk for the respective colors, there are supplied the developers of the respective colors from their associated toner cartridges Ty to Tk used as an example of a developer storage container.

The toner images of the respective colors Y, M, C, K, which are developed on the surfaces of the sensitive bodies Py, Pm, Pc, and Pk, are fed to their associated primary transfer areas Q3 where the sensitive bodies Py, Pm, Pc, and Pk are contacted with an intermediate transfer belt B' used not only as an example of an endless member but also as an example of an intermediate transfer member. To the primary transfer rollers T1*y*, T1*m*, T1*c*, T1*k* which are used as examples of primary transfer devices respectively disposed on the back surface side of the intermediate transfer belt B' in the respective primary transfer areas Q3, at a given timing, there is applied a primary transfer voltage having a reversed polarity to the charging polarity of developer from a power supply circuit E to be controlled by a control portion C. The toner images on the sensitive bodies Py, Pm, Pc, Pk are primarily transferred sequentially to the intermediate transfer belt B', while they are superimposed on top of each other, in the primary transfer areas Q3 that are disposed opposed to the primary transfer rollers T1*y*, T1*m*, T1*c*, T1*k* respectively. After execution of the primary transfer, the developers remaining on the surfaces of the sensitive bodies Py, Pm, Pc, Pk are removed by their associated sensitive body cleaners CLp which are used as an example of an image holder cleaner.

The above-mentioned sensitive bodies Py to Pk, the respective colors latent image forming devices ROSy to ROSk and the respective colors developing devices Gy to Gk cooperate together in constituting their respective colors toner image forming devices UY, UM, UC, UK which are used as examples of visible image forming devices for forming the respective colors toner images on their associated sensitive bodies Py to Pk.

Downwardly of the respective colors sensitive bodies Py, Pm, Pc, and Pk, there is supported a slide frame F1 used as an example of a guided frame member by a pair of slide rails SR and SR used as examples of a pair of right and left guide members in such a manner that the slide frame F1 can be moved in the back and forth direction. On the slide frame F1, there is supported a belt frame F2 serving as the support frame member of a belt module BM' which is used not only as an example of an endless member drive apparatus according to the embodiment 3 but also as an example of an intermediate transfer body drive apparatus. The belt frame F2 is supported such that it can be raised and lowered between a raised operation position where the intermediate transfer belt B' is contacted with the sensitive bodies Py to Pk and a maintenance position where the intermediate transfer belt B' is spaced downwardly from the sensitive bodies Py to Pk. In a state where the belt module BM' is lowered down to the maintenance position, the slide frame F1 and belt module BM' supported thereby can be moved into and out of the printer portion U1' in such a manner that they can be prevented against frictional contact with the sensitive bodies Py to Pk.

The structure for moving back and forth the slide frame F1 and the structure for moving up and down the belt module BM' are disclosed, for example, in the Japanese patent publication Hei-8-171248 and are thus conventionally known. That is, as these structures, there can be used various kinds of conventionally known structures.

The belt module BM' includes: the intermediate transfer belt B'; belt support rollers Rd, Rt, Rw, Rf, T2*a* including a belt drive roller Rd used as an example of a drive support member, a tension roller Rt as an example of a tension applying member, a walking roller Rw as an example of a meandering preventive member, a plurality of idler rollers Rf as an example of a driven member, and a backup roller T2*a* as an example of a secondary transfer opposing member; and, the four primary transfer rollers Ty, Tm, Tc, Tk. And, the intermediate transfer belt B' is supported by the belt support rollers Rd, Rt, Rw, Rf, Tf2 in such a manner that it can be rotated and moved in the arrow mark Ya direction. That is, according to the embodiment 3, the belt module BM' includes, as an example of a rotatable support member for supporting an endless member, a belt drive roller Rd, a tension roller Rt, a walking roller Rw, a plurality of idler rollers Rf, and a backup roller T2*a*.

As an example of a secondary transfer member, there is disposed a secondary transfer roller T2*a* in such a manner that it faces the surface of the intermediate transfer belt B' in contact with the backup roller T2*a*. In an area where the intermediate transfer belt B' and secondary transfer roller T2*b* faces each other, there is formed a secondary transfer area Q4. To the secondary transfer roller T2*b*, at a given timing, there is applied a secondary transfer voltage having a reversed polarity to the charging polarity of the developer from the power supply circuit E to be controlled by the control portion C. The backup roller T2*a*, which is disposed opposed to the secondary transfer roller T2*b*, is grounded; and, when a secondary transfer voltage is applied to the secondary transfer roller T2*b*, there is formed a secondary transfer electric field between the secondary transfer roller T2*b* and backup roller T2*a*. The backup roller T2*a* and secondary transfer roller T2*b* cooperate together in constituting a secondary transfer device T2.

The belt module BM', which includes the four primary transfer rollers Tv, Tm, Tc, Tk and intermediate transfer belt B', cooperates together with the secondary transfer device T2 and the like in constituting a transfer apparatus BM'+T2 which transfers the toner images formed on the surfaces of the sensitive bodies Py to Pk of the toner image forming devices UY, UM, UC, UK to the recording medium S.

In the lower portion of the printer portion U1', there are disposed not only sheet supply containers TR1 to TR3 with recording mediums S stored therein but also a sheet supplying medium feed passage SH1. Also, to the sheet supplying medium feed passage SH1, there can be supplied sheets from a manual sheet supply portion TR4. The recording mediums S stored in the sheet supply containers TR1 to TR3 are taken out therefrom by pickup rollers Rp used as an example of a take-out member at a given timing, are next separated from each other one by one by handling rollers Rs used as an example of a handling member, and then fed to regi-rollers (registering rollers) Rr used as an example of a sheet supply timing registering member by a plurality of feed rollers Ra used as an example of a feed member. Also, the recoding mediums S supplied from the manual sheet supply portion TR4 are fed to the regi-rollers Rr by the feed rollers Ra. The recording mediums S fed to the regi-rollers Rr are then fed to the secondary transfer area Q4 to a timing when multiple toner colors or monochrome toner images transferred primarily to the intermediate transfer belt B' are moved to the secondary transfer area Q4.

Since the secondary transfer voltage is applied to the secondary transfer roller T2*b* when the recording mediums S pass through the secondary transfer area Q4, color toner images, which are primarily transferred on the intermediate transfer belt B' while they are superimposed on top of each other, are secondarily transferred onto the recording mediums S all at once in the secondary transfer area Q4.

After execution of the secondary transfer, the developer remaining on the surface of the intermediate transfer belt B' is removed by a belt cleaner CLb used as an example of an endless member cleaner.

The recording mediums S, to which the toner images have been secondarily transferred, are fed to a fixing device F by a post-transfer guide member SG and a medium feed member HB. The fixing device F includes a heating roller Fh and a pressure roller Fp which are used as an example of a pair of pressure fixing members which are in pressure contact with each other. A contact area, where the heating roller Fh and pressure roller Fp are contacted with each other, forms a fixing area Q5. The toner images on the recording mediums S are heated and fixed when they pass through the fixing area Q5. The recording mediums S with the toner images fixed thereon are fed to a discharging medium feed passage SH2 or to a double-side recording medium feed passage SH3. The recording mediums S, which have been fed to the discharging medium feed passage SH2, are discharged to a sheet discharge tray TRh used as an example of a medium discharge portion; and, the recording mediums S fed to the double-side recording medium feed passage SH3, are turned upside down and are then fed again to the regi-roller Rr.

The elements, which are designated by the above-mentioned signs Rp, Rs, Ra, Rr, SG, HB, S1, SH2, SH3 and the like, cooperate together in constituting a feed device SH.

The elements, which are designated by the sings SH1, S2 and SH3, cooperate together in constituting the medium feed passages SH1 to SH3. Also, the elements designated by the signs RP, Rs, Rr, HB and the like constitute the medium feed members Rp, Rs, Rr, HB respectively.

In FIG. 7, in the image forming apparatus U according to the embodiment 3, the walking roller Rw is structured similarly to the driven roller Rj according to the embodiment 1.

(Operation of Embodiment 3)

In the image forming apparatus U having the above structure according to the embodiment 3, the walking roller Rw, which not only supports the intermediate transfer belt B' used as an example of an endless member but also prevents the intermediate transfer belt B' from meandering, can be positioned positively using the rotational force of the intermediate transfer belt B'. Also, when the intermediate transfer belt B' leans, similarly to the embodiment 1, the walking roller Rw inclines in a direction to correct the leaning of the intermediate transfer belt B', whereby the leaning of the intermediate transfer belt B' can be corrected.

(Modifications)

Although description has been given heretofore in detail of the embodiments 1 to 3 according to the invention, the invention is not limited to these embodiments but various changes and modifications are also possible without departing from the scope of the subject matter of the invention as set forth in the scope of the patent claims. Description will be given below of modifications (H01) to (H06) according to the invention.

(H01) Although, in the above-mentioned embodiments, as an example of an image forming apparatus, there are illustrated a printer and a copying machine, the invention is not limited to them but the invention can also apply to a FAX or a composite machine having such functions. Also, the medium feed belt according to the embodiment 1 is not limited to an image forming apparatus of an electrophotographic type but it can also apply to an image forming apparatus of an arbitrary image forming type such as a printer of an ink jet recording type or a thermal head type. And, the invention is not limited to an image forming apparatus of a multi-color developing type but it can also apply to an image forming apparatus of a single color type, that is, a so called monochrome developing type. Further, it goes without saying that the invention can apply not only to an image forming apparatus of an arbitrary image forming type but also to an endless member type apparatus or a belt-conveyor type apparatus which is used to feed arbitrary commodities, which include: goods such as finished goods and parts; deliveries such as books, DVDs and clothing; and, transportation goods such as materials and scraps that are handled in a construction site.

(H02) In the above-mentioned embodiments, as an example of an endless member, there are illustrated the medium feed belt B and intermediate transfer belt B'. However, this is not limitative but the invention can also apply to, for example, an endless member in which a belt-shaped sensitive body, a belt-shaped fixing device and other similar elements must be positioned and there is raised a possibility that they can lean.

(H03) In the above-mentioned embodiments, as a rotation support member, there are illustrated the driven roller Rj and walking roller Rw respectively having a function to prevent the meandering of an endless member. However, this structure is not limitative but the invention can also apply to a structure not having the function to prevent such meandering. For example, the invention can also apply to a structure in which the bearing member for supporting the axial-direction two ends of the endless member is replaced with the rear bearing member 7" according to the embodiment 2, or the tension roller Rt and idler roller Rf according to the embodiment 3.

(H04) In the above-mentioned embodiment, there is shown a structure in which the bearing member 7 of the driven roller Rj is urged by the tension spring 8, that is, there is shown the driven roller Rj that has a function to apply a tensile force to the medium feed belt. However, the invention is not limited to this, but it can also apply to a rotatable support member which does not have a function to apply a tensile force.

(H05) In the above-mentioned embodiments, there is illustrated a structure in which the bearing portion 18 has a long hole shape. However, according to the invention, the bearing portion 18 can also have other arbitrary shapes. For example, it is also possible to employ a structure in which the bearing portion 18 has an arc-like shape with the drive shaft Rd as the center thereof and the driven shaft Rj1 can be moved with respect to the drive shaft Rd like a pendulum; or, the bearing portion 18 can also have an inclining rectangular shape.

(H06) In the above-mentioned embodiments, as an example of an end edge contact portion, there is illustrated the round-edge-shaped disk-like flange 12. However, the invention is not limited to this structure but it is also possible to employ an arbitrary structure. For example, there can be employed a so called stepped shaft in which, in the driven shaft Rj1, there is formed, as an example of the end edge contact portion, a stepped portion having a large diameter corresponding to the flange 12. Or, the flange 12 may be pressure inserted into the driven shaft, or the flange 12 may be supported in a rotatable manner.

(Embodiment 4)

Figure 8:
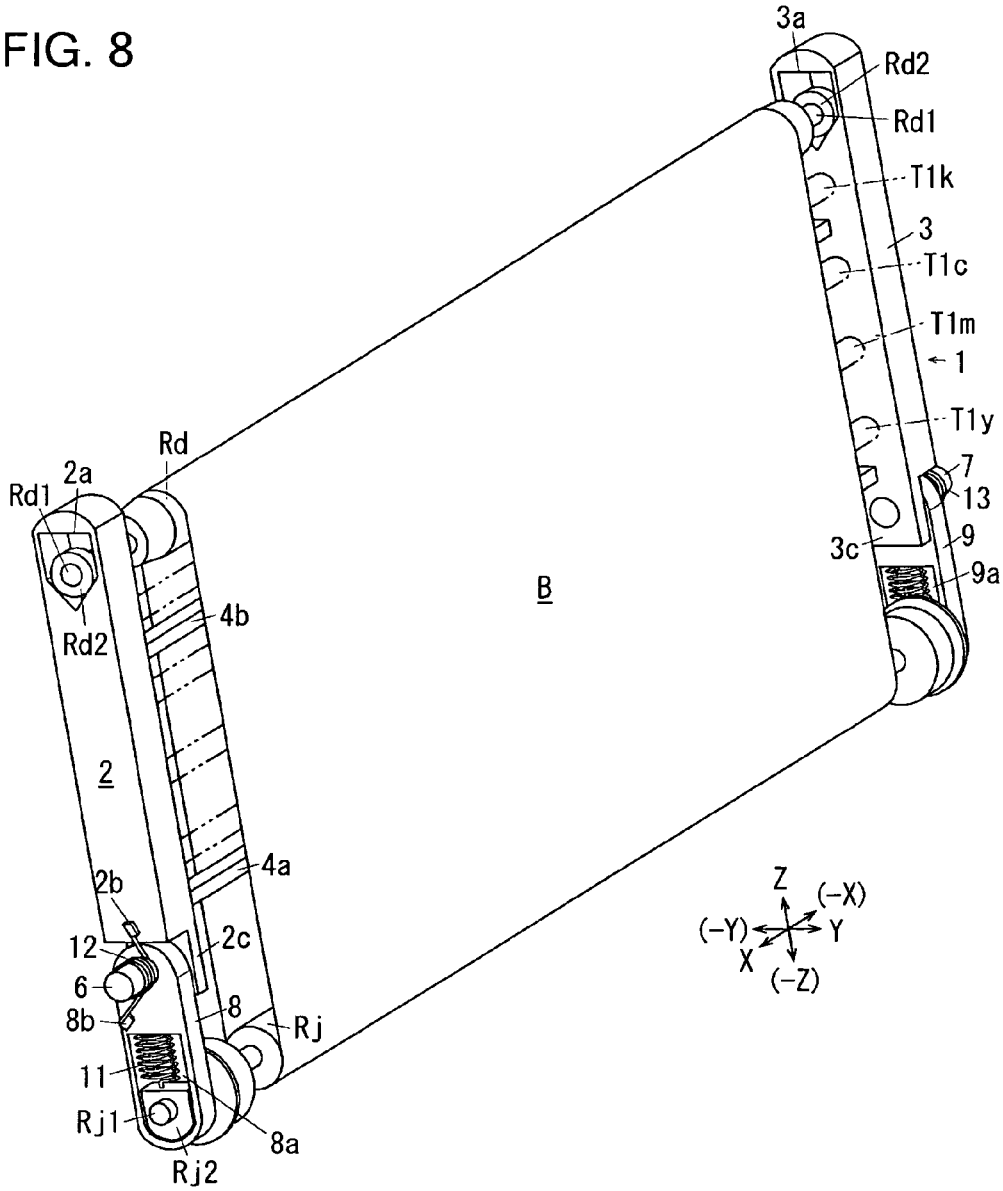
FIG. 8 is an enlarged perspective view of the main portions of a belt module according to the embodiment 1 of the invention.

FIG. 8 is an enlarged perspective view of the main portions of a belt module according to the embodiment 4 of the invention.

Figure 9:
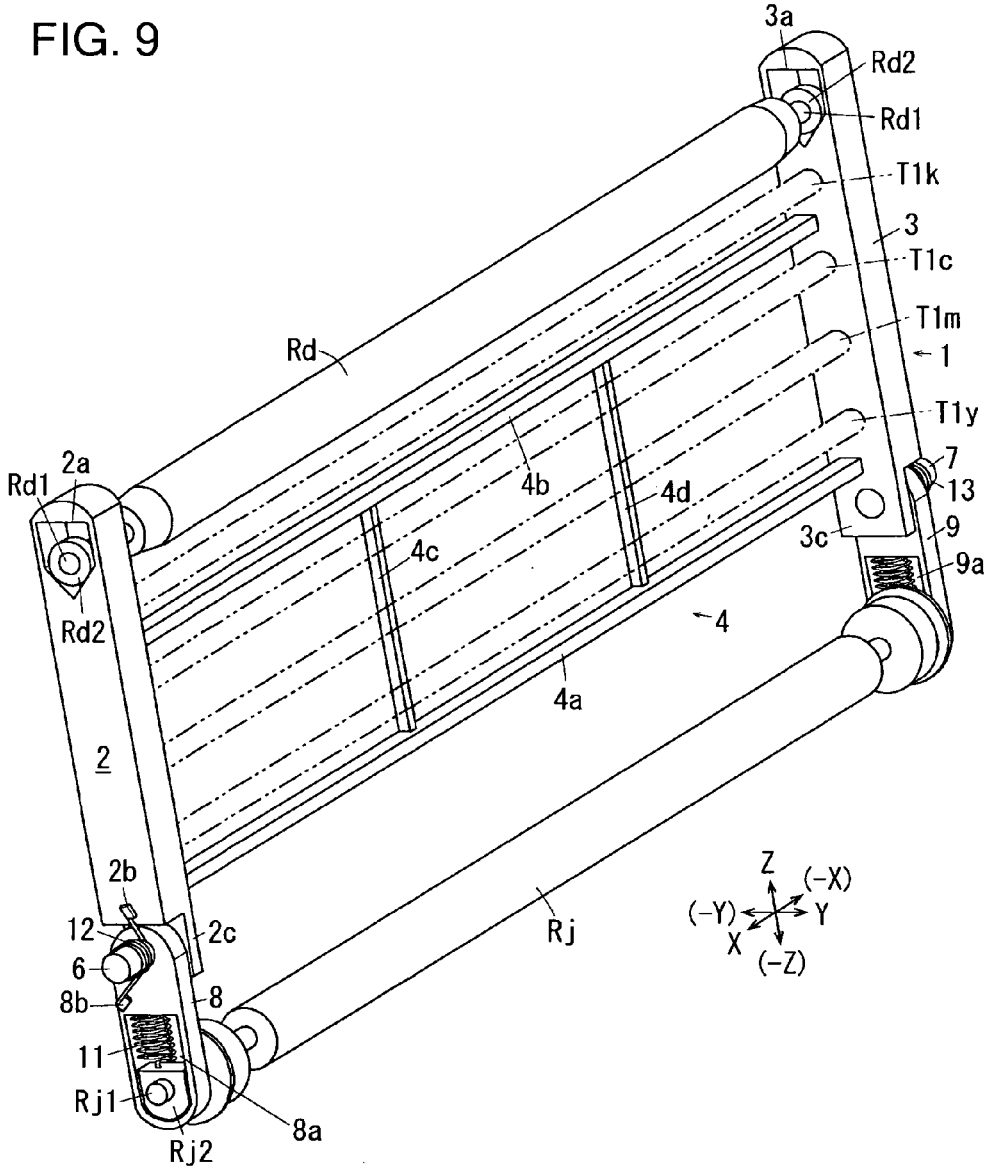
FIG. 9 is an explanatory view of the belt module shown in FIG. 8, showing a state in which a medium feed belt is removed therefrom.

FIG. 9 is an explanatory view of the belt module shown in FIG. 8, showing a state where a medium feed belt is removed therefrom.

Figure 10:
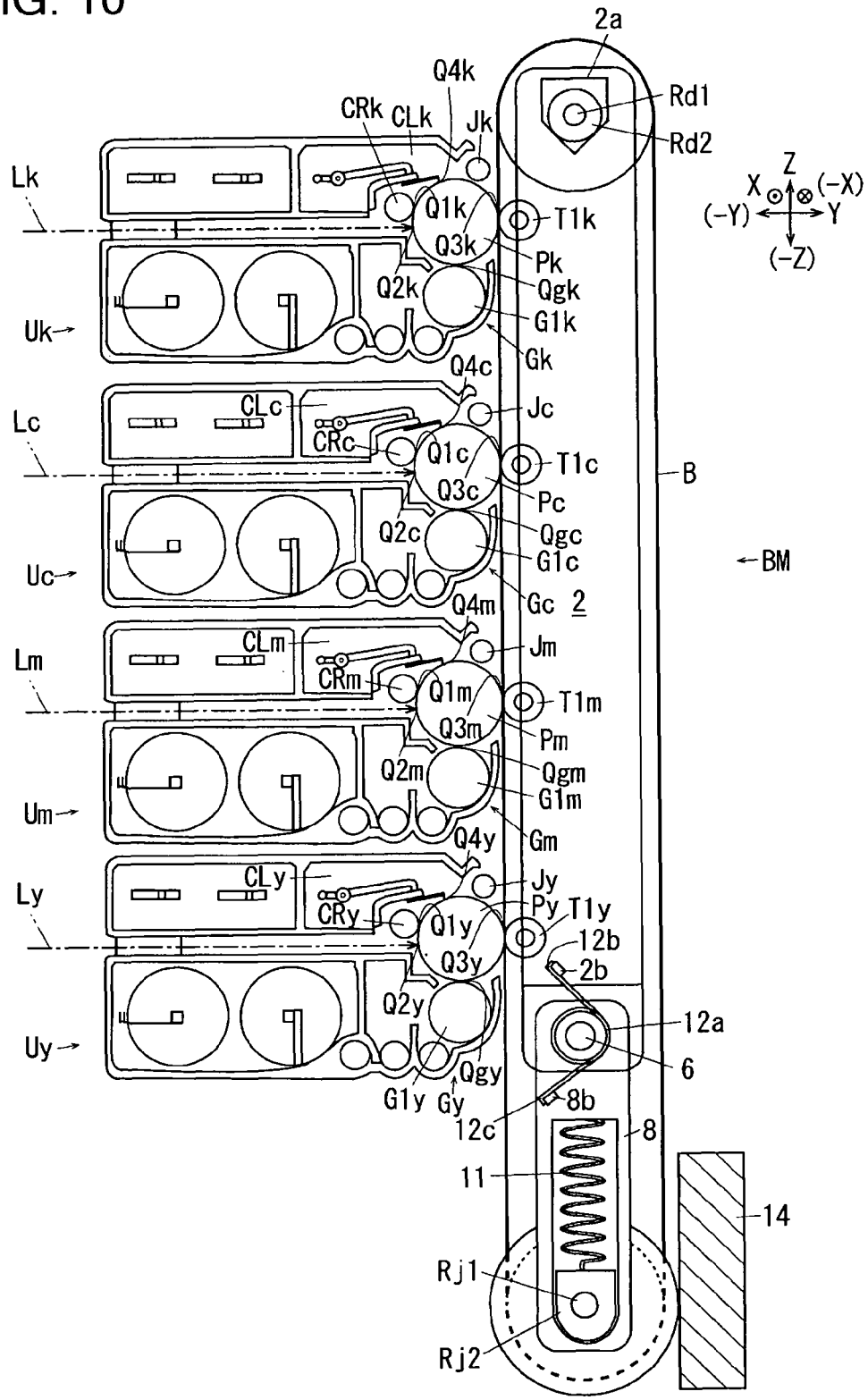
FIG. 10 is an explanatory view of the main portions of a belt module when it is mounted on a printer, here, illustration of a rear side frame body and the like is omitted.

FIG. 10 is an explanatory view of the main portions of a printer with the belt module mounted thereon. In FIG. 10, the illustration of a rear frame body and the like is omitted.

In FIG. 1, there is shown a printer U used as an example of the image forming apparatus according to the embodiment 4 of the invention. In the lower portion of the printer U, there is stored a sheet supply container TR1 into which there is stored a recording medium S used as an example of a medium; and, on the upper surface of the printer U, there is provided a medium discharge portion TRh. Also, on the left upper portion of the printer U, there is provided an operation portion UI.

The printer U according to the embodiment 4 includes an image forming apparatus main body U1 and an open-close portion U2 which can be opened and closed about a rotation center U2*a* set in the right lower end portion of the image forming apparatus main body U1. The open-close portion U2 is structured such that it can be moved between an open position and a closed position. Specifically, the open position is a position where the inside of the image forming apparatus main body U1 is opened in order to supply a developer, or replace a wrong member with a new one, or remove a clogged recording medium S; and, the closed position is a position where an image forming operation is carried out and the open-close portion U2 is held in the normal time.

The printer U includes a control portion C for carrying out various control operations of the printer U, an image processing portion GS, an image write device drive circuit DL, a power supply device E and the like, the operations of which can be controlled by the control portion C. The power supply device E is used to apply a voltage to: charging rollers CRy, CRm, CRc and CRk respectively used as examples of a charging device; developing rollers G1*y*, G1*m*, G1*c* and G1*k* respectively used as examples of a developer hold member; transfer rollers T1*y*, T1*m*, T1*c* and T1*k* respectively uses as examples of a transfer device; and the like.

The image processing portion GS converts print information, which is input therein from an external image information transmission device or the like, to image information for forming latent images corresponding to the images of four colors, that is, Y (yellow), M (magenta), C (cyan) and K (black), and outputs the thus converted image information to the image write device drive circuit DL at a given timing. The image write device drive circuit DL, according to the respective pieces of color image information input therein, outputs a drive signal to a latent image write device ROS. The latent image write device ROS, according to the drive signal, radiates laser beams Ly, Lm, Lc and Lk which are used as examples of an image write light for writing the respective color images.

In FIG. 1, on the right of the latent image write device ROS, there are disposed process cartridges UY, UM, UC and UK serving as examples of a visible image forming device for forming toner images used as examples of the visible images of the respective colors, that is, Y (yellow), M (magenta), C (cyan) and K (black).

In FIGS. 1 and 10, the process cartridge UK for K (black) includes a sensitive body Pk used as an example of an image holder which is rotating. Around the sensitive body Pk, there are arranged a charging roller CRk used as a charging device, a developing device Gk for developing an electrostatic latent image on the surface of the sensitive body Pk to a visible image, an electricity removing member Jk for removing an electricity from the surface of the sensitive body Pk, and a sensitive body cleaner CLk used as an example of an image holder cleaner for removing a developer remaining on the surface of the sensitive body Pk.

In FIGS. 1 and 10, the surface of the sensitive body Pk is charged uniformly by the charging roller CRk in a charging area Qlk disposed opposed to the charging roller CRk. After then, a latent image is written onto the surface of the sensitive body Pk by the laser beam Lk in a latent image forming area Q2*k*. The thus written electrostatic latent image is converted to a visible image in a developing area Qgk disposed opposed to the developing device Gk.

The process cartridge UK for black according to the embodiment 4 is composed of a mounting and removing body which is structured such that the sensitive body Pk, charging roller CRk, developing device Gk, electricity removing member Jk, sensitive body cleaner CLk and the like are formed as an integral body; and also, the process cartridge UK, in a state where the open-close portion U2 is moved to its opening position, can be mounted onto and removed from the image forming apparatus main body U1.

Process cartridges UY, UM and UC for the remaining colors, similarly to the process cartridge UK for black, are also structured such that they can be mounted onto and removed from the image forming apparatus main body U1.

In FIGS. 1 and 8 to 10, on the right of the respective sensitive bodies Py to Pk, there is disposed a belt module BM which serves as an example of an endless member rotate and drive apparatus supported on the open-close portion U2. The belt module BM includes: a medium feed belt B used as an example of an endless member; belt support rollers (Rd+Rj) used as an example of a hold feed member support system, including a drive roller Rd used as an example of a drive support member for supporting the medium feed belt B and a driven roller Rj used as an example of a rotatable support member; transfer rollers T1*y* to T1*k* respectively disposed opposed to their associated sensitive bodies Py to Pk, while the belt support rollers are used as an example of a transfer device; an image density sensor SN1 used as an example of an image density detect member; a belt cleaner CLb used as an example of a hold feed member cleaning device; and, the medium attracting roller Rk disposed opposed to the driven roller Rj for sucking the recording medium S onto the medium feed belt B. The medium feed belt B is rotatably supported by the belt support rollers (Rd+Rj). Here, the image density sensor SN1 is used to detect the density of a density detecting image formed at a given timing by the image density adjusting means (not shown) of the control portion C, that is, the density of a so called patch image. The image density adjusting means, based on the image density detected by the image density detect member, adjusts not only voltages respectively to be applied to the charging rollers CRy to CRk, developing devices Gy to Gk and transfer rollers T1*y* to T1*k* but also the intensities of the laser beams Ly to Lk, thereby adjusting or correcting the image density, that is, carrying out a so called process control.

The recording medium S in the sheet supply container TR1 disposed downwardly of the medium feed belt B is taken out by a sheet supply member Rp and is fed to a recording medium feed passage SH.

The recording medium S in the recording medium feed passage SH is fed by a medium feed roller Ra used as an example of a recording medium feed member and is sent to a regi-roller (registration roller) Rr used as an example of a sheet supply registering member. The regi-roller Rr, at a given timing, feeds the recording medium S to a recording medium sucking position Q6 where the driven roller Rj and medium sucking roller Rk are opposed to each other. The recording medium S fed to the recording medium sucking position Q6 is electrostatically sucked onto the medium feed belt B.

When the recording medium S is supplied from a manually operated sheet supply portion TR0, the recording medium S supplied by a manually operated sheet supply member Rp1 is fed to the regi-roller Rr by the medium feed roller Ra and is then fed to the medium feed belt B.

The recording medium S sucked on the medium feed belt B is allowed to pass through the transfer areas Q3, Q3*m*, Q3*c* and Q3*k* sequentially in this order, where the recording medium S can be contacted with their associated sensitive bodies Py to Pk.

To transfer rollers T1*y* to T1*k* disposed on the back surface side of the medium feed belt B in the transfer areas Q3*y* to Q3*k*, there is applied a transfer voltage having a reversed polarity to the charging polarity of the toner from the power supply circuit E at a given timing.

In the case of a multicolor image, the toner images on the respective sensitive bodies Py to Pk are transferred respectively by the transfer rollers T1*y* to T1*k* to the recording medium S on the medium feed belt B while they are superimposed on top of each other. Also, for a single color image, that is, for a so called monochrome image, only the toner image for K (black) is formed on the sensitive body Pk and thus this K (black) toner image is transferred to the recording medium S by the transfer roller T1*k*.

After execution of the toner image transfer, the charged electricity of the sensitive bodies Py to Pk is removed by the electricity removing members Jy to Jk in the electricity removing areas Qjy to Qjk. After then, the toner remaining on the surfaces of the sensitive bodies Py to Pk is cleaned by their associated sensitive body cleaners CLy to CLk in their respective cleaning areas Q4*y* to Q4*k*; and, after then, the sensitive bodies Py to Pk are respectively charged again by their associated charging rollers CRy to CRk.

The recording medium S, to which the toner image has been transferred, is fixed in a fixing area Q5 which is formed in such a manner that a heating roller Fh used as an example of a heading fixing member of a fixing device F used as a fixer and a pressurizing roller Fp used as an example of a pressurizing and fixing member are pressure contacted with each other. The recording medium S with the image fixed is guided by a guide roller Rgk used as an example of a guide member and is discharged from a discharge roller Rh used as an example of a medium discharge member to the medium discharge portion TRh.

The medium feed belt B, after the recording medium S is removed therefrom, is cleaned by the belt cleaner CLb.

When both sides of the recording medium S are printed, the discharge roller Rh is driven and is rotated reversely, whereby the recording medium S is fed to a medium reverse passage SH2 by a switching member GT1 and is fed again to the regi-roller Rr while the front and back thereof are reversed.

By the way, according to the embodiment 4, the fixing device F, the lower drive roller of the discharge roller Rh, switching gear GT1, and the lower guide surface of the medium reverse passage SH2 are constituted by a so called fixing unit U3. Also, the upper driven member of the discharge roller Rh is supported on the open-close portion U2.

In FIGS. 8 and 9, the belt module BM includes a frame body 1 used as an example of a support body for supporting the medium feed belt B. The frame body 1 includes a front side first frame body 2 disposed on the front side thereof, a rear side first frame body 3 disposed on the rear side thereof, and a connecting frame body 4 for connecting together the front side first frame body 2 and rear side first frame body 3. The connecting frame body 4 includes a lower connecting frame body 4*a* and an upper connecting frame body 4*b* which extends substantially parallel to each other; and, the two connecting frame bodies 4*a* and 4*b* cooperate together in connecting the front side and rear side first frame bodies 2 and 3 to each other.

The lower connecting frame body 4*a* and upper connecting frame body 4*b* are connected to each other by two pieces of inter-frame connecting members 4*c* and 4*d*.

In the front side and rear side first frame bodies 2 and 3, there are formed a pair of front and rear bearing support portions 2*a* and 3*a* for supporting a bearing Rd2 which receives the shaft Rd1 of the drive roller Rd. The bearing support portions 2*a* and 3*a* are respectively formed in a V-shaped groove the leading end of which exists on the lower side thereof when viewed from ahead, that is, a so called V groove.

In the lower end portions of the front side first frame body 2 and rear side first frame body 3, there are formed second frame body support portions 2*c* and 3*c*, respectively.

On the front side of the lower end portion of the front side first frame body 2 and on the rear side of the lower end portion of the rear side first frame body 3, there are formed spring one end mounting portions 2*b* respectively. In FIG. 9, the illustration of the rear side spring one end mounting portion is omitted.

In FIG. 9, as shown by two-dot chained lines, between the front side first frame body 2 and rear side first frame body 3, there are interposed the transfer rollers T1*k*, T1*c*, T1*m* and T1*y* downwardly of the drive roller Rd in such a manner that they are arranged substantially parallel to each other. Also, these transfer rollers are supported rotatably and are urged by springs (not shown) in such a direction that they can be pressed against their associated sensitive bodies Pr, Pc, Pm and Py.

The front side first frame body 2, rear side first frame body 3 and connecting frame body 4 cooperate together in constituting the first frame body 2+3+4 according to the embodiment 4.

On the second frame body support portions 2*c* and 3*c* respectively formed in the lower end portions of the front side first frame body 2 and rear side first frame body 3, there are supported a front side second frame body 8 and a rear side second frame body 9 in such a manner that they can be rotated about their associated rocking shafts 6 and 7.

On the front side of the upper end portion of the front side second frame body 8 and on the rear side of the upper end portion of the rear side second frame body 9, there are formed a pair of front and rear spring other end mounting portion 8*b* respectively. Here, the illustration of the rear side spring one end mounting portion is omitted.

Also, in the front side second frame body 8 and rear side second frame body 9, there are formed a pair of front and rear bearing mounting portions 8*a* and 9*a* for supporting a bearing Rj2, which receives the shaft Rj1 of the driven roller, in such a manner that the bearing Rj2 can be moved in the vertical direction. On the bearing mounting portions 8*a* and 9*a*, there are mounted tension springs 11 which are used to urge the bearing Rj2 downward.

The front side second frame body 8 and rear side second frame body 9 cooperate together in constituting a second frame body 8+9 according to the embodiment 4. The first frame body 2+3+4 and the 4 second frame body 8+9 cooperate together in constituting the frame body 1 according to the embodiment 4.

Therefore, in the frame body 1 according to the embodiment 4, the second frame body 8+9 is supported with respect to the first frame body 2+3+4 in such a manner that it can be rocked about the rocking shafts 6 and 7.

In FIGS. 9 and 10, on the rocking shafts 6 and 7, there are mounted the main bodies 12*a* and 13*a* (not shown) of torsion springs 12 and 13 respectively used as an example of an energizing member. The first ends 12*b* and 13*b* (not shown) of the torsion springs 12 and 13 are supported on the spring one end mounting portions 2*b* and 3*b* (not shown), whereas the second ends 12*c* and 13*c* (not shown) are supported on the spring other end mounting portions 8*b* and 9*b* (not shown).

Therefore, as shown in FIG. 10, the torsion springs 12 and 13 always urge the driven roller Rj, which is supported on the second frame body 8+9 supported in a manner capable of rocking with respect to the first frame body 2+3+4, in such a manner that the driven roller Rj is pressed against a butting wall 14 used as an example of a position restricting portion. The butting wall 14 can be disposed at an arbitrary position except for the arrow marks X and −X directions. Here, description is given of an example in which the butting wall 14 is set at a position for position restriction in the Y direction.

Figure 11A:
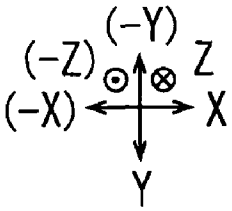
FIGS. 11A and 11B are views of the belt module shown in FIG. 10, when it is viewed from below. Specifically.
Figure 11A:
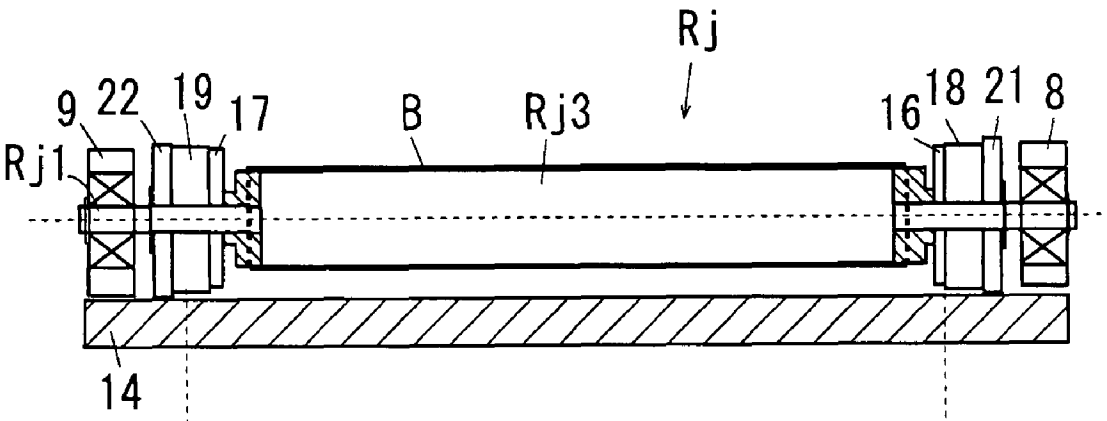
Figure 11B:
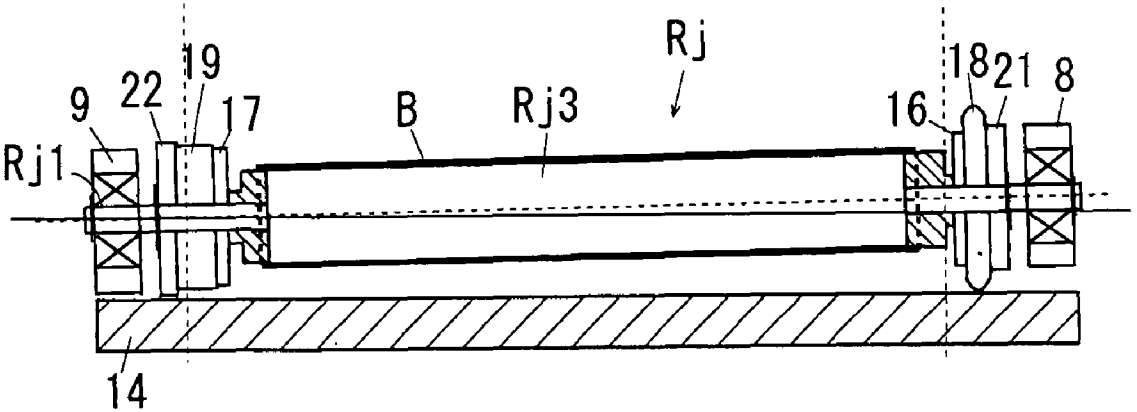

FIGS. 11A and 11B are views of the belt module according to the embodiment 4, when it is viewed from below in FIG. 10. Specifically, FIG. 10A is an explanatory view of a state in which a leaning phenomenon does not occur, and FIG. 10B is an explanatory view of a state in which a leaning phenomenon occurs.

The driven roller Rj includes the shaft Rj1 rotatably supported by the bearing Rj2 and a driven roller main body Rj3 supported to be movable in the axial direction with respect to the shaft Rj1. On the two front and rear ends of the driven roller main body Rj3, there are mounted a disk-shaped front side pressure member 16 and a disk-shaped rear side pressure member 17 which can be moved in the axial direction as the driven roller main body Rj3 moved in the axial direction.

On the front side of the front side pressure member 16 and on the rear side of the rear side pressure member 17, there are supported by the shaft Rj1 a disk-shaped front side elastic member 18 and a disk-shaped rear side elastic member 19 which are used as an example of an elastic member and are made of an elastic block respectively.

On the front side of the front side elastic member 18 and on the rear side of the rear side elastic member 19, there are supported by the shaft Rj1 a disk-shaped front side member to be positioned 21 and a disk-shaped rear side member to be positioned 22 used as n example of a cooperative position restricting portion, while these two members 21 and 22 are larger in diameter than the front and rear elastic members 18 and 19 when they are held in their respective natural states.

(Operation of Embodiment 4)

In the endless member rotate and drive apparatus according to the embodiment 4 having the above-mentioned structure, in a state where the second frame body 8+9 is rotated with respect to the first frame body 2+3+4 to thereby shorten the distance between the drive roller Rd and driven roller Rj, the medium feed belt B is mounted and the second frame body 8+9 is rotated to increase the distance between the drive roller Rd and driven roller Rj as shown in FIGS. 8 and 10, whereby the medium feed belt B is extended and carried using the tension applying springs 11.

And, the second frame body 8+9 is pressed against the butting wall 14 using the torsion springs 12 and 13, so that the front side member to be positioned 21 and the rear side member to be positioned 22 are respectively contacted with the butting wall 14 and are thereby positioned.

When an image forming operation is started and the medium feed belt B is rotated, actually, since the drive roller Rd and driven roller Rj are not arranged perfectly parallel to each other, the medium feed belt B is allowed to lean.

In FIGS. 10A and 10B, when, as the medium feed belt B leans, the driven roller main body Rj3 is moved in the axial direction of the shaft Rj1, the front side pressure member 16 or rear side pressure member 17 arranged in the moving direction is contacted with the front side elastic member 18 or rear side elastic member 19.

When the front side elastic member 18 or rear side elastic member 19 is pressed by the front side pressure member 16 or rear side pressure member 17 and is thereby elastically deformed, the outside diameter thereof is increased. When the outside diameter of the elastically deformed front side elastic member 18 or rear side elastic member 19 exceeds the front side member to be positioned 21 or the rear side member to be positioned 22, the outer peripheral surface of the front side elastic member 18 or rear side elastic member 19 is contacted with the butting wall 14.

As a result of this, the front side second frame body 8 or rear side second body 9, which exists on the side of the elastically deformed front side elastic member 18 or rear side elastic member 19, is rotated against the spring forces of the torsion springs 12 and 13, whereby the shaft Rj1 of the driven roller Rj is inclined. Owing to the inclination of the driven roller Rj, to the medium feed belt B, there is applied a force going in a direction to correct the leaning of the medium feed belt B.

When the leaning of the medium feed belt B is corrected and the driven roller main body Rj3 is moved in a direction where the front side pressure member 16 or rear side pressure member 17 parts away from the elastically deformed front side elastic member 18 or rear side elastic member 19, the front side elastic member 18 or rear side elastic member 19 the elastically deformed front side elastic member 18 or rear side elastic member 19 restores elastically to bring the front side member to be positioned 21 or the rear side member to be positioned 22 into contact with the butting wall 14, thereby returning to the state shown in FIG. 10A.

Also, according to the embodiment 4, on the edges of the axial-direction two end portions of the drive roller Rd and driven roller Rj of the medium feed belt B, there are not provided projection-shaped members, that is, so called ribs; and, therefore, when carrying out the image forming operation, the belt B receives a drive force from the drive roller Rd and is thereby rotated in such a manner that both surfaces thereof are flat surfaces. That is, according to the embodiment 4, the medium feed belt B employs neither a structure in which ribs or the like are bonded to both surfaces of the medium feed belt B and the medium feed belt B is guided using projecting portions such as the ribs, nor a structure in which the end portion of the medium feed belt B in the belt rotating direction is moved up onto a taper-shaped member to thereby distort the flat-surface state of the medium feed belt B; and, therefore, not only when the medium feed belt B is held stationary, but also when it is rotated, the surfaces of the medium feed belt B is held substantially in a flat state. This is useful not only to eliminate the need for provision of the projecting portions such as ribs bonded to the surface of the medium feed belt B to thereby simplify the structure of the medium feed belt B, but also to reduce unnecessary stresses to be applied to the medium feed belt B when it is rotated to thereby prevent the medium feed belt B against damage and restrict the shifting of the position of the image. That is, when the projecting portions such as ribs for guiding the medium feed belt B are bonded to the medium feed belt B, since a portion where the medium feed belt B is to be contacted with the drive roller Rd and driven roller Rj is different from a portion where the projecting portions such as ribs are to be contacted with the drive roller Rd and driven roller Rj, there is generated a circumferential speed difference between the medium feed belt B to be rotated and the projecting portions such as ribs; and, this circumferential speed difference applies stress to the medium feed belt B. However, according to the embodiment 4, this phenomenon is prevented. Also, when the end portion of the medium feed belt B moves up onto the taper-shaped member, the end portion of the medium feed belt B is distorted. However, according to the embodiment 4, this phenomenon is also prevented.

(Embodiment 5)

Figure 12A:
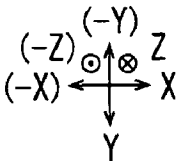
FIGS. 12A to 12C are explanatory views of the main portions of a belt module according to an embodiment 2 of the invention, specifically.
Figure 12A:
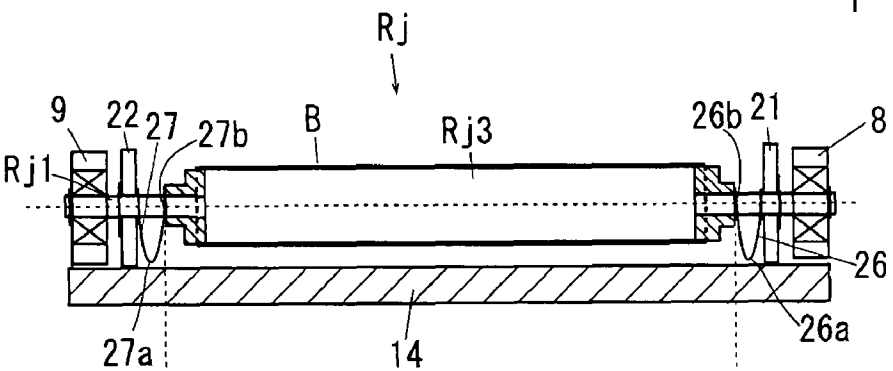
Figure 12B:
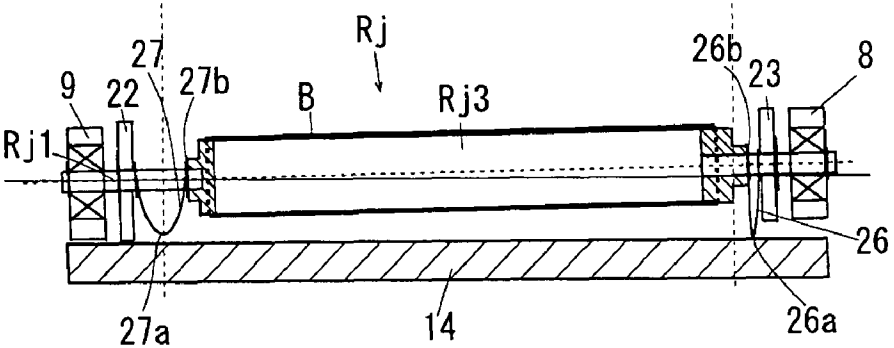
Figure 12C:
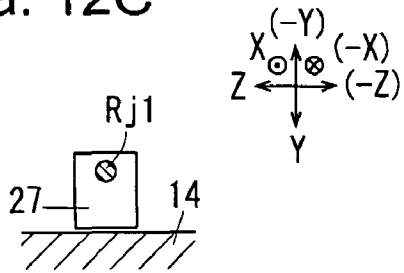

Now, FIGS. 12A to 12C are explanatory views of the main portions of a belt module according no an embodiment 5 of the invention. Specifically, FIG. 12A is an explanatory view thereof, showing a state where a medium feed belt does not lean, FIG. 12B is an explanatory view thereof, showing a state where the medium feed belt leans, and FIG. 12C is an explanatory view of a shaft inclining plate spring.

Next, description will be given below of the embodiment 5 according to the invention. In the description of the embodiment 5, the composing elements thereof corresponding to those of the embodiment 4 are given the same designations and the detailed description thereof is omitted.

The present embodiment is different from the embodiment 4 in the following aspects but it is structured similarly to the embodiment 4 in the other remaining aspects.

In FIGS. 12A to 12C, referring to the structure of a driven roller Rj according to the embodiment 5, the front side pressure member 16 and rear side pressure member 17 are omitted and, instead of the front side elastic member 18 and rear side elastic member 19, there are rotatably supported shaft inclining plate springs 26 and 27 on the shaft Rj1 of the driven roller Rj1 used as an example of an elastic member, while the end portions 26*b* and 27*b* of the shaft inclining plate springs 26 and 27 respectively existing on the side of the driven roller main body Rj3 are supported in such a manner that they can be moved in the axial direction. In FIGS. 12A and 12C, the shaft inclining plate springs 26 and 27 are respectively made of a plate spring which is obtained by bending a rectangular-shaped plate member in a V shape. The V-shaped sharp en edges 26*a* and 26*b* of the shaft inclining plate springs 26 and 27 are disposed opposed to the butting wail 14 and, when the shaft Rj1 is rotated, they are contacted with the butting wall 14, thereby preventing the shaft inclining plate springs 26 and 27 against rotation.

Also, as shown in FIG. 12B, the distance between the sharp end edges 26*a*, 27*a* and the shaft Rj1 becomes longer than the outside diameter of the front side member to be positioned 21 and rear side member to be positioned 22 in a state where the shaft inclining plate springs 26 and 27 are pressed and are thereby deformed elastically. And, as shown in FIG. 12A, the above distance is set such that becomes longer than the outside diameter of the front side member to be positioned 21 and rear side member to be positioned 22 in a state where the shaft inclining plate springs 26 and 27 are not deformed elastically.

(Operation of Embodiment 5)

In an endless member rotate and drive apparatus according to the embodiment 5 having the above structure, in FIG. 12B, when the leaning of the medium feed belt B occurs and the driven roller main body Rj3 is moved in the axial direction of the shaft Rj1, the shaft inclining plate spring 26, which is disposed on the side of the moving direction, is pressed by the driven roller main body Rj3.

As shown in FIG. 12B, when the shaft inclining plate springs 26 and 27 are pressed by the driven roller main body Rj3 and are thereby deformed elastically, the distance between the shaft Rj1 and sharp end edges 26*a*, 27*a* is increased. When the distance between the shaft Rj1 and sharp end edges 26*a*, 27*a* becomes longer than the outside diameter of the front side member to be positioned 21 an rear side member to be positioned 22, the sharp end edges 26*a* and 27*a* of the shaft inclining plate springs 26 and 27 are contacted with the butting wall 14.

As a result of this, similarly to the embodiment 4, the front side second frame body 8 or rear side second body 9, which are situated on the side of the elastically deformed shaft inclining plate springs 26 and 27, are respectively rotated against the spring forces of their associated torsion springs 12 and 13, thereby inclining the shaft Rj1 of the driven roller Rj. Owing to the inclined shaft Rj1, there is applied to the medium feed belt B a force which goes in a direction to correct the leaning of the medium feed belt B.

When the leaning of the medium feed belt B is corrected and the driven roller main body Rj3 is moved in a direction where the elastically deformed shaft inclining plate springs 26 and 27 return to their natural states, the shaft inclining plate springs 26 and 27 are elastically restored, and the front side member to be positioned 21 and the rear side member to be positioned 22 are contacted with the butting wall 14, thereby returning the state of the belt module to the state shown in FIG. 12A.

(Embodiment 6)

Figure 13A:
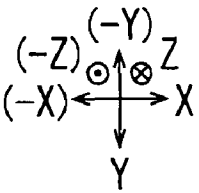
FIGS. 13A and 13B are explanatory views of the main portions of a belt module according to an embodiment 3 of the invention, specifically.
Figure 13A:
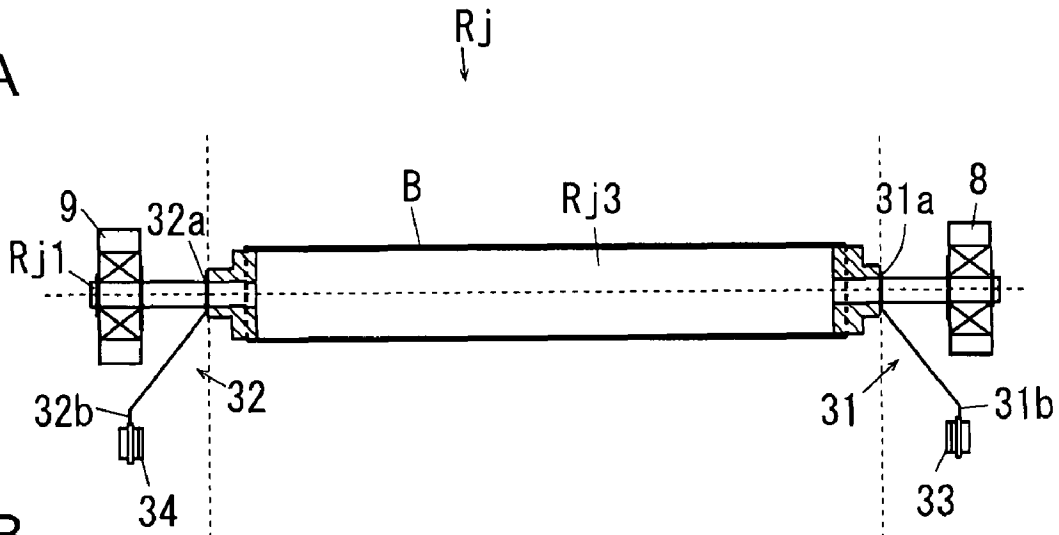
Figure 13B:
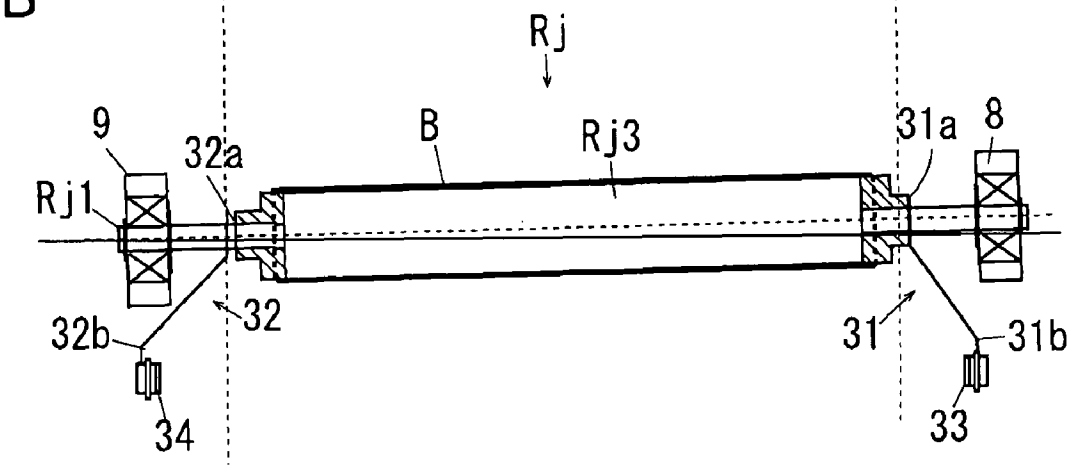

Now, FIGS. 13A and 13B are explanatory views of the main portions of a belt module according to an embodiment 6 of the invention. Specifically, FIG. 13A is an explanatory view thereof, showing a state where a medium feed belt does not lean, and FIG. 13B is an explanatory view thereof, showing a state where the medium feed belt leans.

Next, description will be given below of the embodiment 6 according to the invention. In the description of the embodiment 6, the composing elements thereof corresponding to those of the embodiment 4 are given the same designations and the detailed description thereof is omitted.

The present embodiment is different from the embodiment 4 in the following aspects but it is structured similarly to the embodiment 4 in the other remaining aspects.

In FIGS. 13A and 13B, referring to the structure of a driven roller Rj according to the embodiment, the butting wall 14 as well as the front side pressure member 16 and rear side pressure member 17 according to the embodiment 4 are omitted. Also, instead of the front side elastic member 18 and rear side elastic member 19 as well as the front side member to be positioned 21 and rear side member to be positioned 22 according to the embodiment 4, there are used shaft positioning plate springs 31 and 32 as an example of an elastic member. The respective one-end portions of the shaft positioning plate springs 31 and 32, that is, the shaft support end portions 31*a* and 32*a* are supported on the shaft Rj1 in such a manner that they can be freely rotated and also, as the driven roller main body Rj3 moves in the axial direction thereof, can be freely moved in the axial direction.

The other end portions of the shaft positioning plate springs 31 and 32, that is, the fixed support end portions 31*b* and 32*b* are supported on fixed support portions 33 and 34 which are respectively formed in the printer U.

In the shaft positioning plate springs 31 and 32 according to the embodiment 6, the distance between the fixed support end portions 31*b* and 32*b* is set larger than that between the shaft support end portions 31*a* and 32*a*. The fixed support end portions 31*b* and 32*b* of the plate springs 31 and 32 are respectively disposed on the right of the driven roller Rj1, while the spring forces of the shaft positioning plate springs 31 and 32 are opposed to those of the torsion springs 12 and 13, thereby holding the position of the shaft Rj1 at a reference position shown in FIG. 13A.

(Operation of Embodiment 6)

In the endless member rotate and drive apparatus according to the embodiment 6 having the above structure, in FIG. 13B, when the medium feed belt B leans and the driven roller main body Rj3 moves in the axial direction of the shaft Rj1, the shaft support end portion 31*a* of the shaft positioning plate spring 31 disposed on the moving direction side is pressed by the driven roller Rj3.

As shown in FIG. 13B, when the shaft support end portion 31*a* is pressed by the driven roller Rj3 and the shaft positioning plate spring 31 is thereby deformed elastically, because the fixed support end portion 31*b* is fixed, the shaft support end portion 31*a* is moved in such a manner that it draws an arc about the fixed support end portion 31*b*.

As a result of this, similarly to the embodiment 4, the front side second frame body 8 and rear side second frame body 9, which are disposed on side of the elastically deformed shaft positioning plates 31 and 32, are rotated against the spring forces of the torsion springs 12 and 13, whereby, as shown in FIG. 13B, the shaft Rj1 of the driven roller Rj is inclined. Owing to the inclination of the shaft Rj1, there is applied to the medium feed belt B a force which goes in a direction to correct the leaning of the medium feed belt B.

When the leaning of the medium feed belt B is corrected and the driven roller main body j3 is moved in a direct on where the elastically deformed shaft positioning plate springs 31 and 32 can return to their respective natural states, the shaft positioning plate springs 31 and 32 are allowed to elastically return to their respective natural states, whereby the state of the belt module is returned to a state shown in FIG. 13A.

(Embodiment 7)

Figure 14:
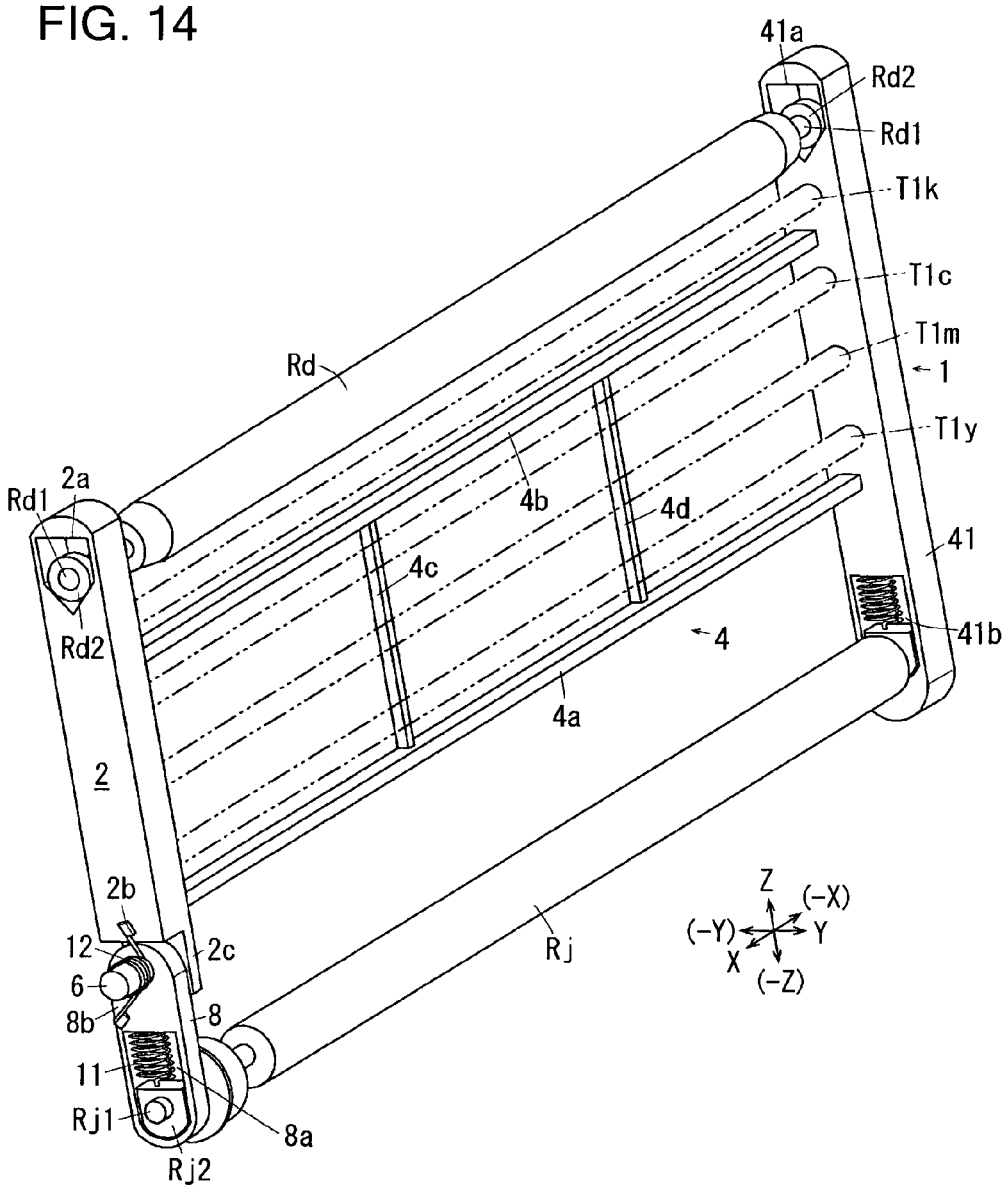
FIG. 14 is an explanatory view of the belt module according to an embodiment 4 of the invention, showing a state where a medium feed belt is removed therefrom.

FIG. 14 is an explanatory view of a belt module according to an embodiment 7 of the invention, showing a state where a medium feed belt is removed therefrom.

Figure 15:
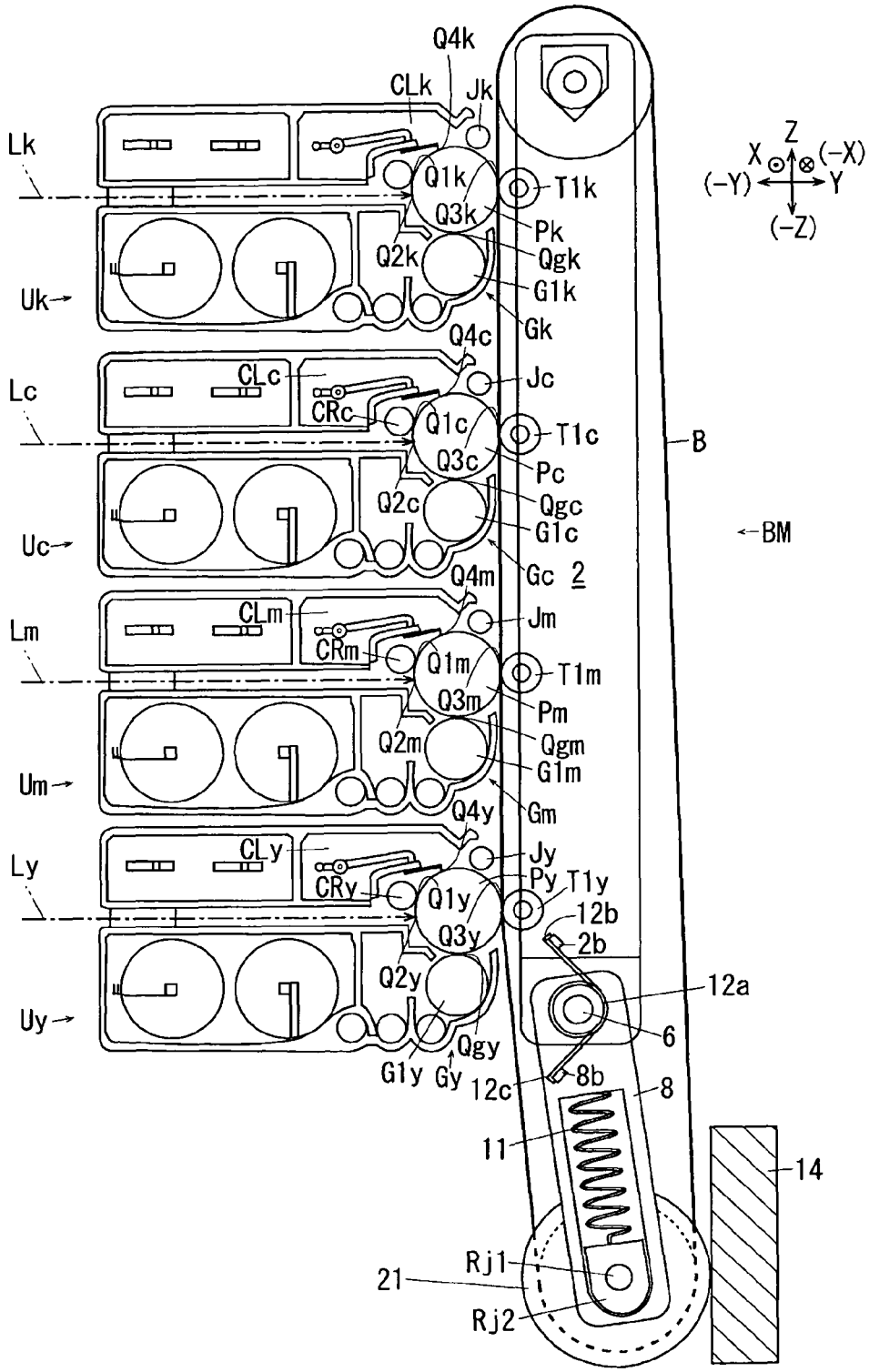
FIG. 15 corresponds to FIG. 10 and is a view of the main portions of the belt module according to the embodiment 4, showing a state where it is mounted on a printer, here, illustration of a rear side frame body and the like is omitted.

FIG. 15 corresponds to FIG. 10 and is a view of the main portions of the belt module according to the embodiment 7, showing a state where the belt module is mounted on a printer. Here, in FIG. 15, the illustration of the rear side frame body and similar composing elements is omitted.

Figures 16A, 16B, 16C:
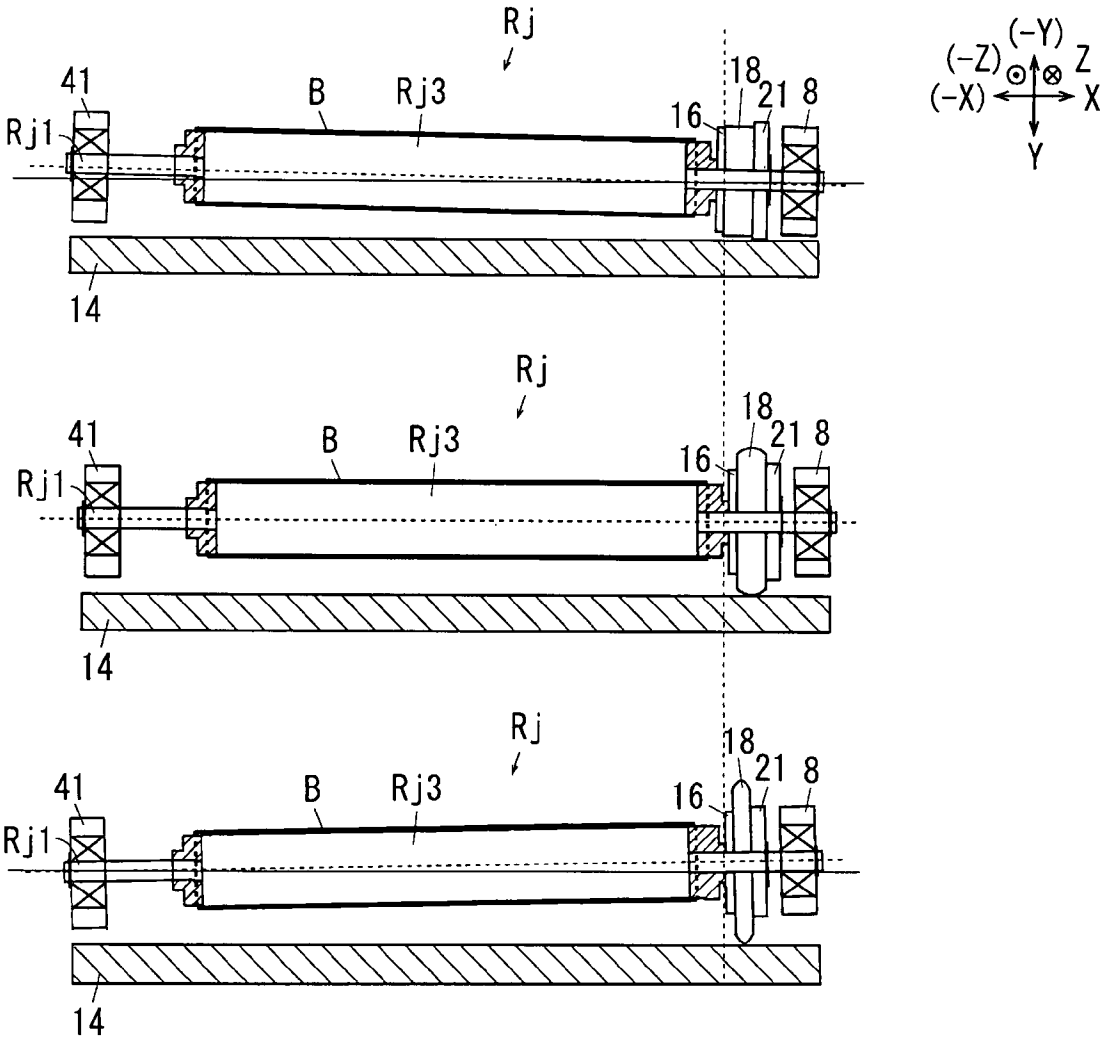
FIGS. 16A to 16C are views of the belt module shown in FIG. 15, when it is viewed from below, specifically.

FIGS. 16A to 16C are views of the belt module according to the embodiment 7, when it is viewed from below in FIG. 15. Specifically, FIG. 16A is an explanatory view of the belt module, showing a state where the belt does not lean; FIG. 16B is an explanatory view of the belt module, showing a state where the belt leans from the state shown in FIG. 16A; and, FIG. 16C is an explanatory view of the belt module, showing a state where the belt leans further from the state shown in FIG. 16B.

Next, description will be given below of the embodiment 7 according to the invention. In the description of the embodiment 7, the composing elements thereof corresponding to those of the embodiment 4 are given the same designations and the detailed description thereof is omitted.

The present embodiment is different from the embodiment 4 in the following aspects but it is structured similarly to the embodiment 4 in the other remaining aspects.

In FIG. 14, in the belt module BM according to the embodiment 7, there are omitted the torsion spring 13, rear side pressure member 17, rear side elastic member 19 and rear side member to be positioned 22 which are respectively used in the belt module BM according to the embodiment 4. And, instead of the rear side first frame body 3 and rear side second frame body 9 according to the embodiment 4, there is used a fixed frame body 41.

The fixed frame body 41 includes a bearing support portion 41*a* structured similarly to the bearing support portion 3*a* according to the embodiment 4 and a bearing mounting portion 41*b* structured similarly to the bearing mounting portion 9*a* according to the embodiment 4. On the bearing support portion 41*a*, there is supported a bearing Rd2; and, on the bearing mounting portion 41*b*, there is held a rear side bearing Rj2 by a tension apply spring 11 in such a manner that the rear side bearing Rj2 can be inclined.

The front side first frame body 2, fixed frame body 41, connecting frame body 4 and the like cooperate together in constituting a support frame body 2+41+4 used as an example of a first frame body.

Therefore, according to the embodiment 7, the front side frame body B is supported such that it can be rocked about the rocking shaft 6 with respect to the support frame body 2+41+4.

Referring to FIGS. 15 and 16A, in the belt module BM according to the embodiment 7, the member to be positioned 21 is butted against the butting wall 14 which is disposed on the right side when compared with the butting wall 14 according to the embodiment 4; and, the second frame body 8 is held in a state where it is rotated right with respect to the shaft hold portion 41*b* of the fixed frame body 41. Owing to this, the shaft Rj1 of the driven roller Ri is inclined as shown in FIG. 16A, whereby the medium feed belt B is naturally allowed to lean forward.

(Operation of Embodiment 7)

In the endless member rotate and drive apparatus according to the embodiment 7 having the above structure, with the operation of the driven roller Rj, the medium feed belt B naturally leans forward. When the driven roller main body Rj3 moves in the axial direction of the shaft Rj1 with the leaning operation of the belt B, as shown in FIG. 16B, the front side pressure member 16 is contacted with and pressed by the front side elastic member 18, so that it is deformed elastically. When the outside diameter of the front side elastic member 18 becomes larger than the member to be positioned 21 due to the elastic deformation of the front side elastic member 18, the outer peripheral surface of the front side elastic member 18 is contacted with the butting wall 14.

As a result of this, the front side second frame body 8 is rotated against the spring force of the torsion spring 12, the shaft Rj1 is inclined and, owing to the inclination of the shaft Rj1, the leaning of the medium feed belt B is reduced.

When the medium feed belt B leans forward further from this state, with the movement of the shaft Rj1 of the driven roller main body Rj in the axial direction, the front side elastic member 18 is pressed by the front side pressure member 16 and is thereby deformed elastically further, the outside diameter of the front side elastic member 18 is increased further as shown in FIG. 16C, and the shaft Rj1 is thereby inclined further. When the shaft Rj1 is inclined further, the leaning of the medium feed belt B can be corrected. When the leaning of the medium feed belt B is corrected, the front side elastic member 18 restores elastically, and the diameter of the front side elastic member 18 is reduced, whereby the medium feed belt returns through the state shown in FIG. 16B to the state shown in FIG. 16A.

(Modifications)

Although description has been given heretore in detail of the embodiments according to the invention, the invention is not limited to these embodiments but various changes or modifications are also possible without departing the scope of the subject matter of the invention that is stated in the scope of the appended patent claims. The followings are the modifications (H01) to (H05) according to the invention.

(H01) In the embodiments respectively described hereinabove, as an example of an image forming apparatus, there is illustrated a printer. However, the invention is not limited to this but the invention can also apply to a copying machine, a FAX, or a composite machine having a plurality of functions such as the function of the copying machine and the function of the FAX. Also, the image forming apparatus is not limited to an electrophotographic type of image forming apparatus but the invention can apply to an image forming apparatus of an arbitrary image forming type such as a printing machine of an ink jet recording type or a thermal head type for printing a lithograph or the like. Also, the invention is not limited to an image forming apparatus of multicolor development but can also be realized by an image forming apparatus of single color development, that is, monochrome development. Further, the invention not only can apply to an image forming apparatus of an arbitrary image forming type but also can apply to an endless member used to carry arbitrary goods, for example, commercial goods such as completed goods and parts, delivery goods such as books, DVDs and clothing, and transportation goods such as materials and scraps which are handled at a construction site.

(H02) In the embodiments respectively described hereinabove, as an example of an endless member, there is illustrated a medium feed belt B.

However, this is not limitative but the invention can also apply to, for example, an intermediate transfer belt used to secondarily transfer a primarily transferred visible image to a medium, and an endless member such as a belt-shaped sensitive belt which raises a possibility that it can lean.

(H03) In the above-mentioned embodiments 1 and 4, there is illustrated a structure in which the driven roller main body Rj3 can be contacted through the front side pressure member 16 and rear side pressure member 17 with the front side elastic member 18 and rear side elastic member 19. However, it is also possible to employ a structure in which, when the driven roller main body Rj3 moves in the axial direction, it can be contacted directly with the elastic members with no intervention of the front side pressure member 16 and rear side pressure member 17.

(H04) In the above embodiments 2 and 3, the two ends of the driven roller Rj are supported by the frame bodies 8 and 9 which can be rocked. However, this is not limitative but, as shown in FIGS. 16A to 16C, only one end side of the driven roller Rj may be supported by a frame body being capable of rocking.

(H05) In the above embodiments, as an example of a support member structured such that a first frame body for supporting the drive roller Rd is connected to a second frame body for supporting the driven roller Rj, there is illustrated the frame body 1. However, this is not limitative but it is also possible to separately structure independent support bodies serving as frame bodies, one for supporting the drive roller Rd and the other for supporting the driven roller Rj.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An endless member drive apparatus comprising:

an endless member that has plane surfaces and rotates by receiving a drive force;

a drive support member that supports and drives the endless member;

a rotatable support member that includes a rotation shaft, and that supports the endless member;

a bearing member that includes:

a bearing portion that supports the rotatable support member rotatably, and that supports the rotatable support member in such a manner that the rotatable support member can be moved in an intersecting direction to intersect a tensile direction where a tensile force is generated in the endless member; and a positioning portion that positions the rotatable support member, wherein the rotatable support member is moved and positioned by using a force that, in a case where the endless member is rotated, is applied to the rotatable support member, and that goes in the intersecting direction;

a positioned portion that is supported on the rotation shaft of the rotatable support member, wherein the bearing portion has a hole portion that extends in the intersecting direction, and that supports the rotatable support member in contact with the outer periphery of the positioned portion so as to support the rotatable support member movably, and the positioning portion has a surface inclined outwardly in an axial direction along the rotation shaft of the rotatable support member, and outwardly in a diameter direction of the rotation shaft of the rotatable support member.

2. The endless member drive apparatus as claimed in claim 1, wherein the hole portion has an elliptical shape or a rectangular shape extending in the intersecting direction, or an arc-like shape.

3. The endless member drive apparatus as claimed in claim 1, further comprising:

two end edge contact portions that are respectively disposed in the axial-direction two end portions of the rotatable support member, wherein the end edge of the endless member is contacted with the end edge contact portions in a case where the endless member leans.

4. An image forming apparatus comprising:

an endless member drive apparatus according to claim 1, the endless member drive apparatus including a medium feed apparatus for feeding a medium while holding the medium on the surface of the endless member; and a visible image forming apparatus that forms a visible image on the medium.

5. An image forming apparatus comprising:

a visible image forming apparatus that forms a visible image;

a primary transfer device that transfers the visible image formed by the visible image forming apparatus to a surface of an intermediate transfer body constituted by the belt-shaped endless member;

an endless member drive apparatus according to claim 1, the endless member drive apparatus including an intermediate transfer body drive apparatus including the intermediate transfer body; and a secondary transfer device that secondarily transfers the visible image on the surface of the intermediate transfer body to a medium.

6. An endless member drive apparatus comprising:

an endless member that has plane surfaces and rotates on receiving a drive force;

a drive and support member that supports and drives the endless member;

a rotatable support member that includes a rotation shaft, supports the endless member, and is rotatable with the rotation of the endless member;

a support member that supports the rotatable support member rotatably, and that supports the rotatable support member in such a manner that the rotatable support member can be moved in a shaft direction along the rotation shaft of the rotatable support member and can be rocked in an intersecting direction to intersect the shaft direction; and an elastic member that is elastically deformable due to a movement of the rotatable support member in the shaft direction caused by the leaning of the endless member, and that is variable in the outer shape thereof in the intersecting direction, wherein the elastic member is varied in the outer shape thereof so as to rock the rotatable support member in a direction to correct the leaning of the endless member, wherein the elastic member comprises a disk-shaped elastic block supported on the rotation shaft of the rotatable support member.

7. The endless member drive apparatus as claimed in claim 6, wherein the elastic member comprises a plate spring having one end supported on the rotatable support member, with the other end supported fixedly.

8. An image forming apparatus comprising:

an endless member drive apparatus according to claim 6, the endless member drive apparatus including a medium feed apparatus that feeds a medium while the medium is attracted to the surface of the endless member; and a visible image forming apparatus that forms a visible image on the medium.

9. An image forming apparatus comprising:

a visible image forming apparatus that forms a visible image;

a primary transfer device that transfers the visible image formed by the visible image forming apparatus to a surface of an intermediate transfer member constituted by a belt-shaped endless member;

an endless member drive apparatus according to claim 6, the endless member drive apparatus including an intermediate transfer member drive apparatus including the intermediate transfer body; and a secondary transfer device that transfers secondarily the visible image on the surface of the intermediate transfer member to a medium.

10. An endless member drive apparatus comprising:

an endless member that includes plane surfaces and rotates on receiving a drive force;

a drive and support member that supports and drives the endless member;

a rotatable support member that supports the endless member and rotates with the rotation of the endless member;

a support member that supports the drive and support member and the rotatable support member rotatably, the rotatable support member being supported such that, in a case where the endless member is rotated, as the endless member moves in the shaft direction of the rotatable support member, the support member can be moved in the shaft direction with respect to the support member, and that is supported such that the support member can be rocked in the intersecting direction with respect to the support member;

an elastic member that is elastically deformable due to a movement of the rotatable support member in the shaft direction, and that is variable in the outer shape thereof in the intersecting direction; and a position restricting portion that restricts a position of the rotatable support member with respect to the intersecting direction, and, in a case where the elastic member varies in the outer shape thereof, restricts the position of the elastic member in the intersecting direction;

a cooperative position restricting member that is supported on the rotatable support member, and that is contactable with the position restricting portion; and an urging member that urges the rotatable support member toward the position restricting portion, wherein the support member includes:

a first frame body that supports the drive and support member; and a second frame body that supports the rotatable support member and is supported in a manner capable of rocking with respect to the first frame body.

11. The endless member drive apparatus as claimed in claim 10, wherein the second frame body supports the two end sides of the rotatable support member in the shaft direction such that the two end sides of the rotatable support member can be rocked with respect to the first frame body, and the position restricting portion, the cooperative position restricting member and the elastic member are respectively set on the two end sides of the rotatable support member in the shaft direction.

12. An endless member drive apparatus comprising: an endless member that includes plane surfaces and rotates on receiving a drive force; a drive and support member that supports and drives the endless member;

a rotatable support member that supports the endless member and rotates with the rotation of the endless member;

a support member that supports the drive and support member and the rotatable support member rotatably, the rotatable support member being supported such that, in a case where the endless member is rotated, as the endless member moves in the shaft direction of the rotatable support member, the support member can be moved in the shaft direction with respect to the support member, and that is supported such that the support member can be rocked in the intersecting direction with respect to the support member;

an elastic member that is elastically deformable due to a movement of the rotatable support member in the shaft direction, and that is variable in the outer shape thereof in the intersecting direction;

a position restricting portion that restricts a position of the rotatable support member with respect to the intersecting direction, and, in a case where the elastic member varies in the outer shape thereof, restricts the position of the elastic member in the intersecting direction;

a cooperative position restricting member that is supported on the rotatable support member, and that is contactable with the position restricting portion; and an urging member that urges the rotatable support member toward the position restricting portion, wherein the support member includes: a first frame body that supports the drive and support member; and a second frame body that supports the rotatable support member and is supported in a manner capable of rocking with respect to the first frame body wherein the second frame body supports the rotatable support member in such a manner that one end side thereof in the shaft direction can be rocked with respect to the first frame body, and the position restricting portion restricts the position of the rotatable support member in a state where the rotatable support member is inclined so as to apply a force allowing the endless member to lean toward the one end side of the rotatable support member.

13. An endless member drive apparatus comprising:

an endless member that has plane surfaces and rotates on receiving a drive force;

a drive and support member that supports and drives the endless member;

a rotatable support member that includes a rotation shaft, supports the endless member, and is rotatable with the rotation of the endless member;

a support member that supports the rotatable support member rotatable, and that supports the rotatable support member in such a manner that the rotatable support member can be moved in a shaft direction along the rotation shaft of the rotatable support member and can be rocked in an intersecting direction to intersect the shaft direction; and an elastic member that is elastically deformable due to a movement of the rotatable support member in the shaft direction caused by the leaning of the endless member, and that is variable in the outer shape thereof in the intersecting direction, wherein the elastic member is varied in the outer shape thereof so as to rock the rotatable support member in a direction to correct the leaning of the endless member wherein the elastic member comprises a plate spring the two ends of which are bent and supported on the rotation shaft of the rotatable support member.

* * * * *